US011073274B2

(12) United States Patent
Mondora

(10) Patent No.: US 11,073,274 B2
(45) Date of Patent: Jul. 27, 2021

(54) ILLUMINATION DEVICES

(71) Applicant: Arya Creations, LLC, Perrysburg, OH (US)

(72) Inventor: Kelly Mondora, Perrysburg, OH (US)

(73) Assignee: Arya Creations, LLC, Perrysburg, OH (US)

( * ) Notice: Subject to any disclaimer, the term of this patent is extended or adjusted under 35 U.S.C. 154(b) by 217 days.

(21) Appl. No.: 16/022,776

(22) Filed: Jun. 29, 2018

(65) Prior Publication Data

US 2019/0003699 A1 Jan. 3, 2019

Related U.S. Application Data

(60) Provisional application No. 62/527,356, filed on Jun. 30, 2017.

(51) Int. Cl.

| | |
|---|---|
| ***F21V 21/30*** | (2006.01) |
| ***F21V 33/00*** | (2006.01) |
| ***F21V 23/04*** | (2006.01) |
| ***F21V 5/00*** | (2018.01) |
| ***F21V 21/096*** | (2006.01) |
| ***A45D 42/10*** | (2006.01) |

(Continued)

(52) U.S. Cl.

CPC ..... *F21V 33/004* (2013.01); *A45D 42/10* (2013.01); *F21V 5/00* (2013.01); *F21V 21/0965* (2013.01); *F21V 21/30* (2013.01); *F21V 23/0414* (2013.01); *F21S 6/002* (2013.01); *F21S 6/004* (2013.01); *F21S 8/033* (2013.01); *F21V 33/0052* (2013.01); *F21Y 2103/33* (2016.08)

(58) Field of Classification Search

CPC ..... F21V 33/004; F21V 5/00; F21V 21/0965; F21V 21/30; F21V 21/0414; F21V 33/0052; A45D 42/10; F21Y 2103/33; F21S 6/002; F21S 6/004; F21S 8/033

USPC ..... 248/466, 469, 474, 476, 479

See application file for complete search history.

(56) References Cited

U.S. PATENT DOCUMENTS

| | | | |
|---|---|---|---|
| 3,039,217 | A | 6/1962 | Stefanakis |
| 3,474,242 | A | 10/1969 | Forrant |

(Continued)

FOREIGN PATENT DOCUMENTS

| | | |
|---|---|---|
| CN | 2363558 | 2/2000 |
| CN | 2925206 | 7/2007 |

(Continued)

*Primary Examiner* — Nkeisha Smith

(74) *Attorney, Agent, or Firm* — MacMillan, Sobanski & Todd, LLC

(57) ABSTRACT

Illumination devices, kits that include an illumination device, and methods of using an illumination device are described herein. An example embodiment of an illumination device includes a base, a frame support, a frame, a support arm, a light source, and a switch. The base has first and second ends. The frame is attached to the base and has a frame main body that defines a frame opening. The support arm is releasably attached to the frame and is partially disposed within the frame opening. The support arm has a support arm attachment portion that is sized and configured to releasably attach an electronic device to the support arm. The light source is attached to the frame and has an on state and an off state. The switch is operatively connected to the light source and is adapted to move the light source between the on state and the off state.

19 Claims, 15 Drawing Sheets

(51) Int. Cl.

| | |
|---|---|
| *F21S 6/00* | (2006.01) |
| *F21S 8/00* | (2006.01) |
| *F21Y 103/33* | (2016.01) |

(56) References Cited

U.S. PATENT DOCUMENTS

| | | | | |
|---|---|---|---|---|
| 3,476,927 | A | 11/1969 | Rothman | |
| 3,650,195 | A * | 3/1972 | Jones | G03B 15/041 396/422 |
| 4,085,436 | A | 4/1978 | Weiss | |
| 4,734,831 | A | 3/1988 | Keyser et al. | |
| 4,916,595 | A | 4/1990 | Naruke et al. | |
| 4,942,685 | A | 7/1990 | Lin | |
| 5,575,552 | A | 11/1996 | Faloon et al. | |
| 5,690,420 | A * | 11/1997 | Saldana, Sr. | B60Q 1/2657 362/275 |
| 6,082,881 | A | 7/2000 | Hicks | |
| 6,544,036 | B1 | 4/2003 | Brattesani | |
| 7,127,163 | B2 | 10/2006 | Lee et al. | |
| 7,152,991 | B2 | 12/2006 | Jines et al. | |
| D539,951 | S | 4/2007 | Qui | |
| 7,631,979 | B1 | 12/2009 | Brown et al. | |
| 7,652,716 | B2 | 1/2010 | Qiu et al. | |
| D611,177 | S | 3/2010 | Waring | |
| 7,712,907 | B2 | 5/2010 | Zyka | |
| 7,893,953 | B2 | 2/2011 | Krestakos et al. | |
| 7,919,197 | B2 | 4/2011 | Negishi et al. | |
| 8,162,502 | B1 * | 4/2012 | Zadro | A45D 42/10 362/141 |
| 8,224,175 | B2 | 7/2012 | Yang | |
| 8,356,908 | B1 | 1/2013 | Zadro | |
| 8,428,644 | B1 | 4/2013 | Harooni | |
| 8,556,447 | B2 | 10/2013 | Griggs | |
| 8,625,023 | B2 | 1/2014 | Rolston | |
| 8,651,715 | B2 | 2/2014 | Stakoe et al. | |
| 8,735,922 | B2 | 5/2014 | Tsai | |
| 8,876,307 | B2 | 11/2014 | Geddes et al. | |
| 9,068,737 | B2 | 6/2015 | Kirchberger et al. | |
| D736,001 | S | 8/2015 | Yang et al. | |
| 9,170,353 | B2 | 10/2015 | Chang | |
| D747,398 | S | 1/2016 | Lee et al. | |
| 9,232,846 | B2 * | 1/2016 | Fung | A45D 42/10 |
| D749,329 | S | 2/2016 | Kaiser | |
| 9,304,285 | B2 * | 4/2016 | Barbour | F16M 1/00 |
| 9,341,320 | B2 | 5/2016 | Kim et al. | |
| 9,426,346 | B2 | 8/2016 | Sanchez | |
| 9,593,842 | B2 | 3/2017 | Shoemake et al. | |
| 9,596,395 | B1 | 3/2017 | Hines | |
| 9,638,410 | B2 * | 5/2017 | Yang | G02B 6/0096 |
| 9,797,592 | B2 * | 10/2017 | Marcus | A45C 11/00 |
| 10,187,558 | B2 * | 1/2019 | Rolston | A46B 7/04 |
| 10,320,108 | B2 * | 6/2019 | Hoshikawa | F21S 6/00 |
| 10,398,213 | B2 * | 9/2019 | Vargas | H04N 5/2251 |
| 2002/0196333 | A1 | 12/2002 | Gorischek | |
| 2003/0041871 | A1 | 3/2003 | Endo et al. | |
| 2005/0237735 | A1 | 10/2005 | Fan | |
| 2007/0139515 | A1 | 6/2007 | Du Breuil | |
| 2008/0002400 | A1 | 1/2008 | Huang | |
| 2008/0180933 | A1 | 7/2008 | Geddes | |
| 2008/0297591 | A1 | 12/2008 | Aarts et al. | |
| 2010/0315816 | A1 | 12/2010 | Madelin | |
| 2011/0117959 | A1 * | 5/2011 | Rolston | A45D 40/18 455/556.1 |
| 2013/0163274 | A1 | 6/2013 | Gerber | |
| 2013/0194775 | A1 | 8/2013 | Geddes et al. | |
| 2013/0201653 | A1 | 8/2013 | Shoemake et al. | |
| 2013/0201683 | A1 | 8/2013 | Kirchberger et al. | |
| 2013/0235607 | A1 | 9/2013 | Yang et al. | |
| 2014/0016353 | A1 | 1/2014 | Chang | |
| 2014/0055978 | A1 | 2/2014 | Gantz et al. | |
| 2014/0085500 | A1 | 3/2014 | Rolston | |
| 2014/0340742 | A1 | 11/2014 | Fahlbusch et al. | |
| 2014/0362555 | A1 | 12/2014 | Turk | |
| 2014/0362562 | A1 | 12/2014 | Fung | |
| 2015/0029710 | A1 | 1/2015 | Kim et al. | |
| 2015/0207963 | A1 | 7/2015 | Sayag | |
| 2015/0216331 | A1 * | 8/2015 | Sanchez | A45D 42/16 362/140 |
| 2015/0229747 | A1 | 8/2015 | Goddard | |
| 2016/0201857 | A1 | 7/2016 | Lim et al. | |
| 2016/0277660 | A1 * | 9/2016 | Kaiser | H04N 5/2256 |
| 2017/0071316 | A1 * | 3/2017 | Perez | A45D 42/10 |
| 2017/0118385 | A1 * | 4/2017 | Vargas | H04N 5/2251 |
| 2017/0264118 | A1 * | 9/2017 | Miller | A45D 42/02 |
| 2020/0116347 | A1 * | 4/2020 | Frydenger | F21V 33/004 |

FOREIGN PATENT DOCUMENTS

| | | |
|---|---|---|
| CN | 103919351 | 1/2013 |
| EP | 1574897 | 4/2009 |

* cited by examiner

ILLUMINATION DEVICES

RELATED APPLICATIONS

This application claims the benefit of U.S. Provisional Application No. 62/527,356, filed on Jun. 30, 2017. The disclosure of this related application is hereby incorporated into this disclosure by reference.

FIELD

The disclosure relates generally to the field of illumination devices. More particularly, the disclosure relates to illuminations devices that can be used with an electronic device, kits that include an illumination device, and methods of using an illumination device.

BACKGROUND

Vanity lights are generally used by individuals to apply make-up or otherwise attend to an individual's appearance. For example, before filming content that is intended to be uploaded to the Internet, or live-streamed to a network, an individual may desire to adjust their appearance using a vanity light. Subsequent to using the vanity light, the content is generally acquired through a small video camera on an electronic device, such as a laptop, tablet, or smartphone. However, because the individual creating the content is not usually located in a photography studio or other environment that provides lighting optimized for film and/or photography, the content is not always the clearest and most appealing with respect to the appearance of the individual. Poor lighting is a primary reason for the diminished quality of content obtained from cameras included on electronic devices. The content tends not to accurately portray the appearance of the environment being filmed and the individual being filmed may not appear as attractive as they otherwise would in person. Proper lighting ensures an aesthetically pleasing appearance of the individual being filmed and enhances the overall quality of the content being produced.

A need exists, therefore, for new and useful illumination devices, kits that include illumination devices, and methods of using illumination devices.

SUMMARY OF SELECTED EXAMPLE EMBODIMENTS

Various illumination devices, kits that include an illumination device, and methods of using an illumination device are described herein.

An example illumination device includes a base, a frame, a support arm, a light source, and a switch. The base has a first end and a second end. The frame is attached to the base and has a frame main body that defines a frame opening. The support arm is releasably attached to the frame and is partially disposed within the frame opening. The support arm has a support arm attachment portion that is sized and configured to releasably attach an electronic device to the support arm. The light source is attached to the frame and has an on state and an off state. The switch is operatively connected to the light source and is adapted to move the light source between the on state and the off state.

Another example illumination device includes a base, a frame support, a frame, a support arm, a light source, a lens, a mirror, and a switch. The base has a first end and a second end. The frame support is attached to the base and has a frame support main body that defines a frame support opening. The frame is rotatably attached to the frame support and is partially disposed within the frame support opening. The frame has a first configuration, a second configuration, and a frame main body that defines a frame opening and a frame recess. The support arm is releasably attached to the frame when the frame is in the second configuration and is partially disposed within the frame opening. The support arm has a support arm attachment portion that is sized and configured to releasably attach an electronic device to the support arm. The light source is attached to the frame and is disposed within the frame recess. The light source has an on state and an off state. The lens is attached to the frame and is disposed over the light source. The mirror is releasably attached to the frame and is disposed within the frame opening when the frame is in the first configuration. The switch is operatively connected to the light source and is adapted to move the light source between the on state and the off state.

Another example illumination device includes a base, a frame, a support arm, a light source, a lens, a mirror, and a switch. The base has a first end and a second end. The frame is moveably attached to the base. The base has a first configuration, a second configuration, and a third configuration and a frame main body that defines a frame recess. The support arm is attached to the frame when the frame is in each of the first configuration, the second configuration, and the third configuration. The support arm has a support arm attachment portion that is sized and configured to releasably attach an electronic device to the support arm when the frame is in the second configuration. The light source is attached to the frame and disposed within the frame recess. The light source has an on state and an off state. The lens is attached to the frame and disposed over the light source. The mirror is releasably attached to the support arm when the frame is in the third configuration. The mirror has a mirror casing formed of a magnetic material that is adapted to releasably attach the mirror casing to the support arm. The switch is operatively connected to the light source and is adapted to move the light source between the on state and the off state.

An example kit comprises an illumination device according to an embodiment; instructions for use; and a storage container.

An example method of using an illumination device comprises the steps of: applying a force on a mirror disposed within a frame of an illumination device away from the frame until the mirror becomes free of the frame; obtaining a support arm; applying a force on the support arm toward the frame of the illumination device until the support arm is releasably attached to the frame; obtaining an electronic device; applying a force on the electronic device toward the support arm until the electronic device is releasably attached to the support arm; applying a force on a switch of the illumination device until the light source moves from an off state to an on state; and using the electronic device.

Additional understanding of the example illumination devices, kits that include an illumination device, and methods of using an illumination device can be obtained by review of the detailed description, below, and the appended drawings.

DETAILED DESCRIPTION

The following detailed description and the appended drawings describe and illustrate various example embodiments of illumination devices, kits that include an illumination device, and methods of using an illumination device. The description and illustration of these examples are provided to enable one skilled in the art to make and use an illumination device, to make a kit that includes an illumination device, and to practice a method of using an illumination device. They are not intended to limit the scope of the claims in any manner.

Figure 1:
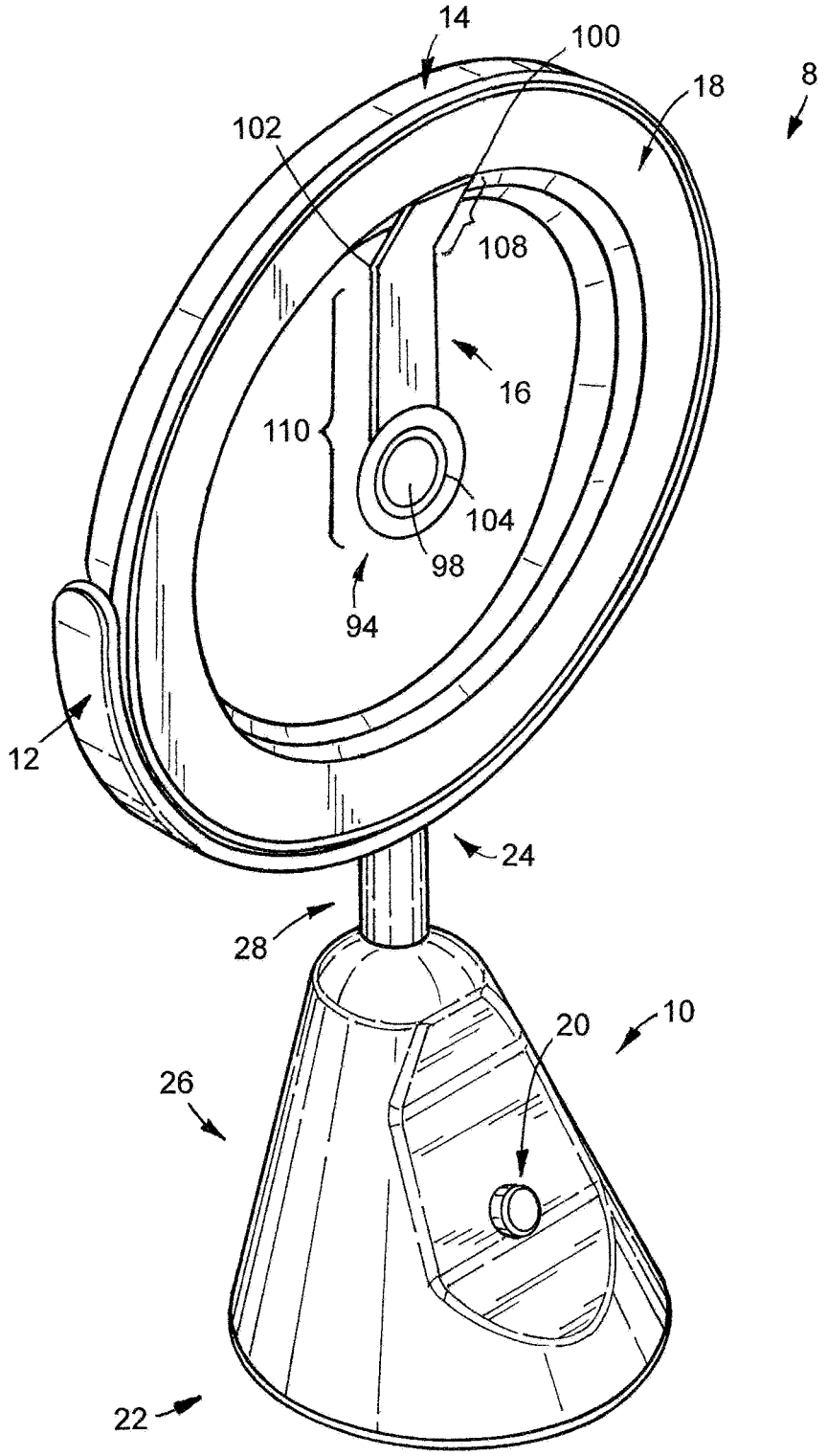
FIG. 1 is a perspective view of an example illumination device.
Figure 2:
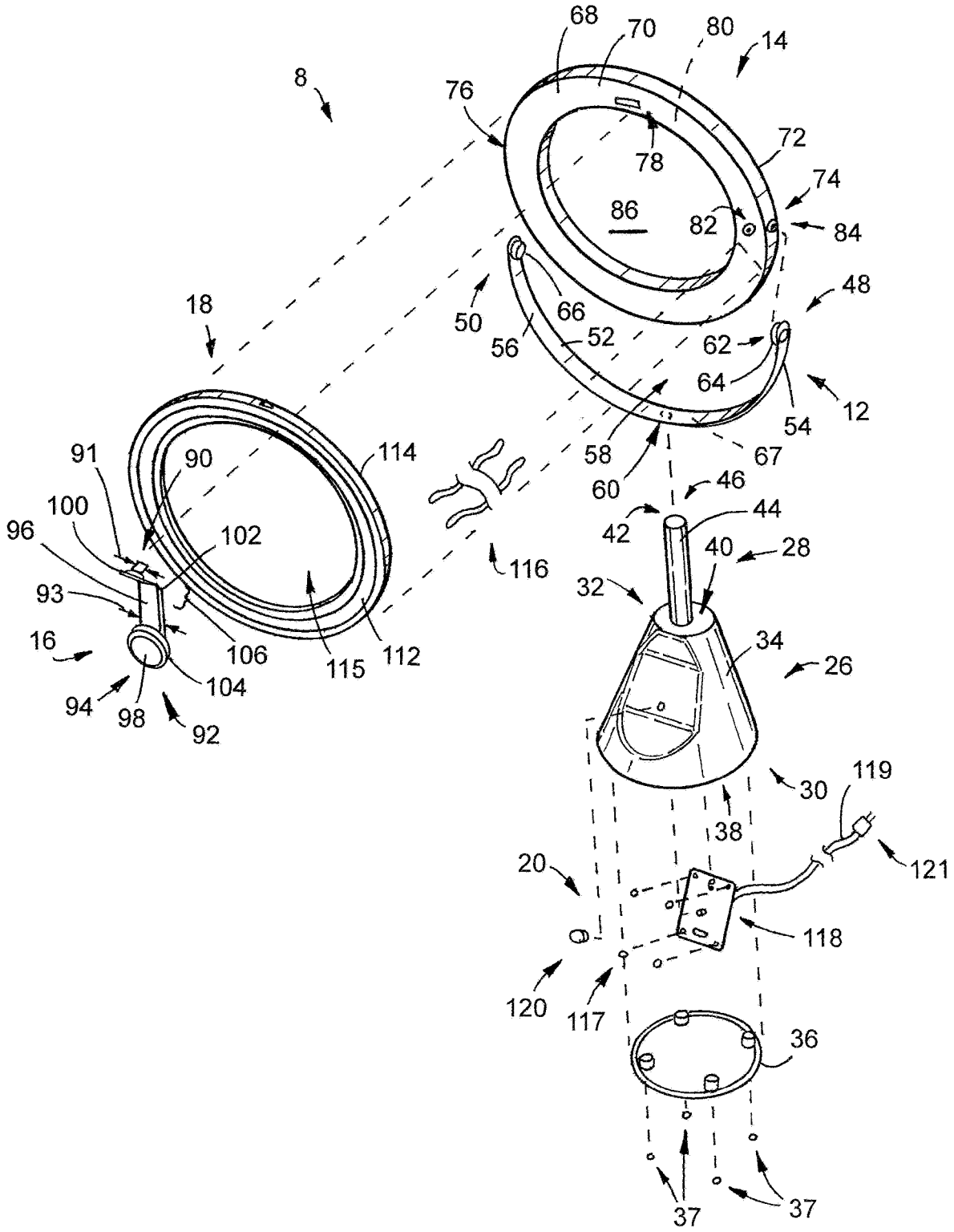
FIG. 2 is an exploded perspective view of the illumination device illustrated in FIG. 1.

FIGS. 1 and 2 illustrate a first example illumination device 8. The illumination device 8 includes a base 10, a frame support 12, a frame 14, a support arm 16, a light source 18, and a switch 20.

The base 10 has a base first end 22, a base second end 24, a stand 26, and an elongate shaft 28 attached to the stand 26. The stand 26 extends from the base first end 22 toward the base second end 24 and has a stand first end 30, a stand second end 32, a stand main body 34, and a stand plate 36. The stand main body 34 and the stand plate 36 cooperatively define a stand chamber 38 that is sized and configured to house various components that operatively connect the light source 18 to the switch 20, as described in more detail herein. In the illustrated embodiment, the stand plate 36 is releasably attached to the stand main body 34. The elongate shaft 28 has an elongate shaft first end 40 attached to the stand 26, an elongate shaft second end 42, and an elongate shaft main body 44 that defines an elongate shaft passageway 46 that extends through the elongate shaft 28. The elongate shaft passageway 46 is in communication with the stand chamber 38 and is sized and configured to house various components that operatively connect the light source 18 to the switch 20, as described in more detail herein.

Any suitable technique or method of releasably attaching a stand plate to a stand main body can be utilized and selection of a suitable technique or method can be based on various considerations, including the material that forms a stand main body. Examples of techniques and methods of attachment considered suitable between a stand plate and a stand main body include using fasteners, using threaded fasteners, adhesives, fusing, welding, and any other technique or method considered suitable for a particular embodiment. In the illustrated embodiment, threaded fasteners 37 are utilized to releasably attach the stand plate 36 to the stand main body 34.

While the base 10 has been illustrated as including a stand 26 and an elongate shaft 28, a base can include any suitable type and number of components and selection of suitable type of component and of a suitable number of components to include on a base can be based on various considerations, including the intended use of an illumination device of which the base is a component. Examples of suitable number of components to include on a base include zero, one, at least one, two, three, four, and any other number considered suitable for a particular embodiment. Examples of components considered suitable to include on a base include stands, such as those described herein, elongate shafts, such as those described herein, stands independent of elongate shafts, stands that include elongate shafts that are movable (e.g., rotatable) relative to the stand, components adapted to releasably attach an elongate shaft relative to a base, and any other component considered suitable for a particular embodiment. While the base 10 has been illustrated as having a particular structural arrangement, a base can have any suitable structural arrangement and selection of suitable structural arrangement for a base included in an illumination device can be based on various considerations, including the structural arrangement of a frame intended to be attached to the base. Examples of structural arrangements considered suitable for a base include those in which a stand does not define a chamber, an elongate shaft does not define a passageway, bases that include a stand that provides access to a stand chamber using a plate that is disposed on a side of the stand, bases that are cuboids, bases that have a prismatic shape, and any other structural arrangement considered suitable for a particular embodiment. Optionally, any of the illumination devices described herein can include a pad attached to the first end of a base that is formed of an anti-skid material (e.g., rubber) to prevent movement of the illumination device during use.

The frame support 12 is attached to the base 10 and has a frame support first end 48, a frame support second end 50, a frame support first surface 52, a frame support second surface 54, and a frame support main body 56 that defines a frame support opening 58, a frame support first passageway 60, a frame support second passageway 62, a frame support first projection 64, a frame support second projection 66, and a frame support chamber 67. The frame support opening 58 is sized and configured to receive a portion of the frame 14. Each of the frame support first passageway 60 and the frame support second passageway 62 extends through the frame support main body 56, is sized and configured to receive various components that operatively connect the light source 18 to the switch 20, and provides access to the frame support chamber 67. The frame support first passageway 60 is defined on the frame support second surface 54 and extends through the frame support main body 56 to the frame support chamber 67. The frame support second passageway 62 is defined on the frame support first projection 64 and extends through the frame support main body 56 to the frame support chamber 67. Each of the frame support first projection 64 and the frame support second projection 66 extends from the frame support first surface 52 and away from the frame support second surface 54 and is sized and configured to be received by a recess 74, 76 defined by the frame 14, as described in more detail herein. In the illustrated embodiment, each of the frame support first projection 64 and the frame support second projection 66 is disposed on an axis that extends through the center of the frame support opening 58 such that the frame support first projection 64 is opposably positioned from the frame support second projection 66 relative to the center of the frame support opening 58. In the illustrated embodiment, the frame support 12 is attached to the base 10 between the frame support first end 48 and the frame support second end 50 such that the frame support chamber 67 is in communication with the elongate shaft passageway 46 via the frame support first passageway 60. The frame support chamber 67 extends from the first support first end 48 to the frame support second end 50 is sized and configured to house various components that operatively connect the light source 18 to the switch 20, as described in more detail herein.

While the frame support 12 has been illustrated as having a particular structural arrangement, a frame support can have any suitable structural arrangement and selection of suitable structural arrangement for a frame support included in an illumination device can be based on various considerations, including the structural arrangement of a frame intended to be attached to the frame support. Examples of structural arrangements considered suitable for a frame support include those define a partial, or complete, cylinder, triangular prism, rectangular prism, hexagonal prism, or any other prism, or arrangement that defines an opening sized and configured to receive a portion, or the entirety, of a frame, and any other structural arrangement considered suitable for a particular embodiment. In the illustrated embodiment, the frame support 12 defines a partial cylinder that defines a frame support opening 58 that is sized and configured to receive a portion of the frame 14.

While the frame support 12 has been illustrated as being attached to the base 10 between the frame support first end 48 and the frame support second end 50, a frame support can be attached to a base at any suitable location on the frame support and can be attached to a base using any suitable technique or method of attachment. Selection of a suitable location to attach a frame support to a base and of a suitable technique or method of attachment between a frame support and a base can be based on various considerations, including the material that forms a frame support and/or a base. Examples of locations considered suitable to attach a frame support to a base include at a frame support first end, at a frame support second end, between a frame support first end and a frame support second end, on a surface of a frame support, on more than one surface of a frame support, and any other location considered suitable for a particular embodiment. Examples of techniques and methods of attachment considered suitable between a frame support and a base include welding, spot welding, fusing, using fasteners, using threaded fasteners, using adhesives, and any other technique or method considered suitable for a particular embodiment. In alternative embodiments, a frame support can be omitted and a frame can be directly attached to a base, as described in more detail with respect to illumination device 408.

While the frame support 12 has been illustrated as having first and second passageways 60, 62 and as having first and second projections 64, 66, a frame support can include any suitable number of passageways and projections. Selection of a suitable number of passageways and projections to include on a frame support can be based on various considerations, including the number of light sources included in an illumination device of which the frame support is a component. Examples of numbers of passageways and/or projections considered suitable to include on a frame support include zero, one, at least one, two, a plurality, three, four, five, and any other number considered suitable for a particular embodiment.

In the illustrated embodiment, the frame 14 is moveably (e.g., rotatably) attached to the frame support 14, is partially disposed within the frame support opening 58, and is movable between a first configuration and a second configuration. In the first configuration, the support arm 16 is free of attachment to the frame 14. In the second configuration, the support arm 16 is releasably attached to the frame 14 (e.g., can be removed from the frame with damaging the support arm 16 or the frame 14).

The frame 14 has a frame main body 68 that defines a frame front surface 70, a frame back surface 72, a frame first recess 74, a frame second recess 76, a frame third recess 78, a frame chamber 80, a frame first passageway 82, a frame second passageway 84, and a frame opening 86. Each of the frame first recess 74 and the frame second recess 76 extends into the frame main body 68 and is sized and configured to receive a portion of a frame support projection 64, 66. In the illustrated embodiment, each of the frame first recess 74 and the frame second recess 76 is disposed on an axis that extends through the center of the frame 14 such that the frame first recess 74 is opposably positioned from the frame second recess 76 relative to the center of the frame 14. The frame third recess 78 extends from the frame front surface 70 toward the frame back surface 72 and is sized and configured to receive a portion of a support arm 16. In the illustrated embodiment, the frame third recess 78 is disposed on an axis that extends through the center of the frame 14 and is orthogonal to the axis that contains the frame first recess 74 and the frame second recess 76. The frame chamber 80 is sized and configured to house various components that operatively connect the light source 18 to the switch 20, as described in more detail herein. Each of the frame first passageway 82 and the frame second passageway 84 extends through the frame main body 68 and provides access to the frame chamber 80. The frame first passageway 82 is defined on the frame front surface 70 and extends to the frame chamber 80. The frame second passageway 84 is defined within the frame first recess 74 and extends to the frame chamber 80. The frame opening 86 extends from the frame front surface 70 to the frame back surface 72 and is sized and configured to receive a portion of a support arm 16, as described in more detail herein.

In the illustrated embodiment, rotatable attachment between the frame support 12 and the frame 14 is accomplished by positioning the frame support first projection 64 within the frame first recess 74 and the frame support second projection 66 within the frame second recess 76. The size and configuration of the projections 64, 66 and the recesses 74, 76 provide a mechanism for releasable and rotatable attachment between the frame support 12 and the frame 14. In the illustrated embodiment, this is accomplished via a snap fit attachment between the frame support 12 and the frame 14 that provides a degree of friction between the frame 14 and the frame support 12 such that the frame 14 remains in a desired position during use. A frame support and a frame can have any suitable structural arrangement to accomplish releasable and rotatable attachment relative to one another. Selection of a suitable structural arrangement can be based on various considerations, including the material that forms a frame support and/or a frame. Examples of structural arraignments considered suitable include those in which each projection is cylindrical and each recess defines a cylindrical void sized and configured to receive a projection, a projection and recess that define a cooperating snap fit configuration that allows a frame to be releasably attached to a frame support, and any other structural arrangement considered suitable for a particular embodiment. In alternative embodiments, a frame can be directly attached to a base such that it is fixedly attached to the base, releasably attached to the base, moveably attached to the base, moveably and releasably attached to the base, rotatably attached to the base, or releasably and rotatably attached to the base.

While the frame 14 has been illustrated as having a frame first recess 74 and a frame second recess 76, a frame can include any suitable number of recesses. Selection of a suitable number of recesses to include on a frame can be based on various considerations, including the number of projections defined by a frame support. Examples of numbers of recesses considered suitable to define on a frame include zero, one, at least one, two, a plurality, three, four, five, and any other number considered suitable for a particular embodiment.

While the frame support 12 and the frame 14 have been illustrated as being moveably attached to one another using a snap fit attachment, a frame support and a frame can be attached to one another using any suitable technique or method of attachment. Selection of a suitable technique or method of attachment between a frame support and a frame can be based on various considerations, including the material that forms a frame support and/or a frame. Examples of techniques and methods of attachment considered suitable between a frame support and a frame include welding, spot welding, fusing, using fasteners, using threaded fasteners, fixedly attaching a frame to a frame support, moveably attaching a frame to a frame support, moveably and releasably attaching a frame to a frame support, rotatably attaching a frame to a frame support, releasably attaching a frame to a frame support, rotatably and releasably attaching a frame to a frame support, snap fit configurations, and any other technique or method considered suitable for a particular embodiment. In alternative embodiments in which a frame is attached directly to a base, the techniques and methods of attachment described herein can also be used between the frame and the base.

While the frame support 12 has been illustrated such that each of the frame support first projection 64 and the frame support second projection 66 is disposed on an axis that extends through the center of the frame support opening 58, the frame 14 has been illustrated such that each of the frame first recess 74 and the frame second recess 76 is disposed on an axis that extends through the center of the frame 14, and the frame 14 has been illustrated such that the frame third recess 78 is disposed on an axis that extends through the center of the frame 14 and is orthogonal to the axis that contains the frame first recess 74 and the frame second recess 76, any arrangement is considered suitable. Selection of a suitable arrangement for a frame support and a frame can be based on various considerations, including the structural arrangement of a support arm intended to be used with an illumination device of which the frame support and/or frame are components. For example, a frame support first projection and a frame support second projection can be disposed on separate axes that are disposed at any suitable angle relative to one another, a frame first recess and a frame second recess can disposed on a separate axes that are disposed at any suitable angle relative to one another, and/or a frame third recess can be disposed on an axis that extends through the center of a frame and is disposed at any suitable angle to an axis that contains a frame first recess and/or a frame second recess.

While the frame 14 has been illustrated as defining a third recess 78 that is sized and configured to receive a portion of a support arm 16, a frame can define any suitable number of recesses and/or structural arrangement capable of providing releasable and/or fixed attachment between a frame and a support arm. Alternatively, other components of an illumination device can define structure and/or include components to accomplished releasable attachment between a support arm and a portion of an illumination device. Selection of a suitable number of recesses and of a structural arrangement for a frame, or other component of an illumination device, can be based on various considerations, including the structural arrangement of a support arm intended to be attached to the frame, or other component of the illumination device. Examples of numbers of recesses considered suitable to include on a frame, or other component of an illumination device, to attach a support arm to the frame, or component, include zero, one, at least one, two, a plurality, three, four, five, and any other number considered suitable for a particular embodiment. Examples of structural arrangements considered suitable for a frame, or other component of an illumination device, include those that define more than one recess that are sized and configured to receive a portion of a support arm, those that define more than one passageways or slots that are sized and configured to receive a portion of a support arm, those that define structure (e.g., one or more projections) that are sized and configured to be receive by a support arm, and any other structure considered suitable for a particular embodiment.

While the frame 14 has been illustrated as having a particular structural arrangement, a frame can have any suitable structural arrangement and selection of suitable structural arrangement for a frame included in an illumination device can be based on various considerations, including the structural arrangement of a frame support intended to be attached to the frame. Examples of structural arrangements considered suitable for a frame include those define a partial, or complete, cylinder, triangular prism, rectangular prism, hexagonal prism, or any other prism, that defines an opening sized and configured to receive a portion, or the entirety, of a support arm, those that define one or more threaded passageways or recesses sized and configured to receive a fastener such that one or more secondary accessories can be attached to the frame using the fastener, and any other structural arrangement considered suitable for a particular embodiment. In the illustrated embodiment, the frame 14 defines a complete cylinder that defines a frame opening 86 that is sized and configured to receive a portion of the support arm 16.

The support arm 16 is releasably attached to the frame 14 and has a support arm first end 90, a support arm second end 92, a support arm attachment portion 94, a support arm main body 96, and a support arm magnet 98. The support arm main body 96 defines a support arm first bend 100, a support arm second bend 102 that is different than the first bend 100, a support arm recess 104, a support arm first portion 106, a support arm second portion 108, and a support arm third portion 110. The support arm first end 90 is releasably attached to the frame 14. The support arm first portion 106 extends from the support arm first end 90 to the support arm first bend 100 and has a first width 91 that is sized and configured to be received by the frame third recess 78. The support arm second portion 108 extends from the support arm first bend 100 to the support arm second bend 102 and has a second width 93 that is greater than the first width 91. The support arm third portion 110 extends from the support arm second bend 102 to the support arm attachment portion 94. The support arm attachment portion 94, which in the illustrated embodiment includes the support arm recess 104 and the support arm magnet 98, is disposed at the support arm second end 92. The support arm magnet 98 is disposed within the support arm recess 104 and is sized and configured to accomplish releasable attachment between the support arm 16 and an electronic device, as described in more detail herein. The support arm recess 104 is sized and configured to receive a portion of the support arm magnet 98. In alternative embodiments, however, a support arm recess can be sized and configured to receive the entirety of a support arm magnet.

In the illustrated embodiment, each of the support arm first bend 100 and the support arm second bend 102 is a predefined bend that positions the support arm attachment portion 94 at a location between a first plane that contains the frame front surface 70 and a second plane that contains the frame back surface 72. The support arm first bend 100 positions the support arm first portion 106 at an acute angle relative to the support arm second portion 108. The support arm second bend 102 positions the support arm second portion 108 at an obtuse angle relative to the support arm third portion 110. This structural arrangement of the support arm 16 provides a mechanism for attaching an electronic device to the support arm 16 such that the frame 14 is out of view of any recording device being used by the electronic device and allows for the light source 18 to be directed toward an individual using the illumination device 8 and the electronic device (e.g., the illumination device is adapted to be used with an electronic device). In addition, this structural arrangement provides a mechanism for reducing camera flare during use. Alternative embodiments, however, can include a support arm first bend and a support arm second bend that are equal to, or about equal to, one another.

While the support arm 16 has been illustrated as having a particular structural arrangement, a support arm included in an illumination device can have any suitable structural arrangement. Selection of a suitable structural arrangement for a support arm can be based on various considerations, including the structural arrangement of an electronic device intended to be used within an illumination device of which the support arm is a component. For example, a support arm can define any suitable number of bends, such as zero, one, at least one, two, a plurality, three, four, five, six, seven, and any other number considered suitable for a particular embodiment. In addition, a support arm can define bends such that the portions of the support arm that are adjacent to the bends are positioned at any suitable angle relative to one another, such as an acute angle, an obtuse angle, a right angle, a straight angle, a reflex angle, and any other angle considered suitable for a particular embodiment. Furthermore, a support arm can have a first portion that has a first width that is sized and configured to be received by a frame recess and a support arm second portion that has a second width that is the same as the first width such that the support arm has a constant width along its entire length, or a portion of its length, and can accomplish releasable attachment to a frame, or other component of an illumination device. Moreover, a support arm can have any suitable structural arrangement and examples of structural arrangements considered suitable for a support arm include elongate members, cylinders, triangular prisms, rectangular prisms, hexagonal prisms, and any other structural arrangement considered suitable for a particular embodiment. In the illustrated embodiment, the support arm 16 is an elongate member and has a support arm first end 90 that is releasably attached to the frame 14. However, in alternative embodiments, a support arm second end, both a support arm first end and a support arm second end, a portion of a support arm disposed between a support arm first end and a support arm second end, or a portion of a support arm, can be attached to a frame, or other component of an illumination device.

While the support arm 16 has been illustrated such that the support arm attachment portion 94 is disposed at the support arm second end 92 and at a location between a first plane that contains the frame front surface 70 and a second plane that contains the frame back surface 72 when the support arm is attached to the frame 14, a support arm can position an attachment portion at any suitable location on the support arm and relative to a frame. Examples of locations considered suitable to position a support arm attachment portion include at a support arm first end, at a support arm second end, between a support arm first end and a support arm second end, and any other location considered suitable for a particular embodiment. Examples of locations considered suitable to position an attachment portion of a support arm relative to a frame include those in which the support arm attachment portion is disposed between a first plane that contains the frame front surface and a second plane that contains the frame back surface, those in which the support arm attachment portion is disposed outside of a space between a first plane that contains the frame front surface and a second plane that contains the frame back surface, those in which the support arm attachment portion is disposed adjacent to the a first plane that contains the frame front surface but outside of a space between the first plane and a second plane that contains the frame back surface, those in which the support arm attachment portion is disposed adjacent to the a first plane that contains the frame back surface but outside of a space between the first plane and a second plane that contains the frame front surface, and any other location considered suitable for a particular embodiment.

While the support arm first end 90 has been illustrated as releasably attached to the frame 14, any suitable portion of a support arm can include structure and/or components that accomplish releasable attachment to a portion of an illumination device. Selection of suitable structure and/or components to include on a support arm can be based on various considerations, including the structural arrangement of a frame, or other component, to which the support arm is intended to be attached. Examples of structures and components considered suitable to releasably attach a support arm to a portion of an illumination device, such as a frame, include using one or more ends and recesses, as shown in FIGS. 1 and 2, using one or more ends and slots and one or more magnets, as shown in FIGS. 3, 4, 5, 6, 7, and 8, using one or more magnets, using one or more ends and slots, combinations of the structures and components described herein, and any other structure or component considered suitable for a particular embodiment.

While the support arm attachment portion 94 has been illustrated as including the recess 104 and the magnet 98, a support arm attachment portion 94 can comprise any suitable structure and/or component capable of providing releasable attachment between a support arm and an electronic device. Selection of a suitable structure and/or component to include as a support arm attachment portion can be based on various considerations, including the structural arrangement of an electronic device intended to be attached to a support arm. Examples of structures and/or components considered suitable to include on a support arm attachment portion include on or more magnets, one or more clamps that are sized and configured to releasably attach an electronic device to an illumination device, one or more elastic bands that are sized and configured to releasably attach an electronic device to an illumination device, combinations of the structures and/or components described herein, and any other structure and/or components considered suitable for a particular embodiment.

Any suitable magnet can be included on a support arm and selection of a suitable magnet can be based on various considerations, including the type of electronic device intended to be releasably attached to the support arm. Examples of types of magnets considered suitable to attach to a support arm include materials that produce a magnetic field, materials that can be made magnetic, materials that can be magnetized, materials that form permanent magnets, ferromagnetic materials, ferrite, permanent magnets, rare-earth permanent magnets, neodymium magnets, and any other magnet considered suitable for a particular embodiment. A magnet included on a support arm can be attached to the support arm using any suitable technique or method of attachment. Selection of a suitable technique or method of attachment between a magnet and a support arm can be based on various considerations, including the type of magnet being attached to a support arm. Examples of techniques and methods of attachment considered suitable between a magnet and a support arm include using adhesives, welding, fusing, snap fit attachments, threaded fasteners, and any other technique or method considered suitable for a particular embodiment.

Any suitable type of electronic device can be releasably attached to a support arm and selection of a suitable type of electronic device to attach to a support arm can be based on various considerations, including the structural arrangement of a frame and/or support arm. Examples of types of electronic devices considered suitable to releasably attach to a support arm include smart phones, tablets, cellular phones, communications devices, such as devices that include wireless networking technology (e.g., Wi-Fi, Bluetooth) or other communications functionalities, devices that include one or more cameras for recording content, such as still photographs and/or video, combinations of the electronic devices described herein, and any other electronic device considered suitable for a particular embodiment.

The light source 18 has an on state and an off state, is attached to the frame 14, and is operatively connected to the switch 20. In the illustrated embodiment, the light source 20 is attached to the frame front surface 70 such that the frame third recess 78 is open and accessible for attachment of the support arm 16. Any suitable light source having any suitable structural arrangement can be included in an illumination device. Examples of light sources considered suitable to include in an illumination device include commercially-available light sources, arrays of lights sources, bi-colored light sources, tri-colored lights sources, light sources that are configured to emit one or more colors simultaneously or separately, light sources that have a high Color Rendering Index (CRI), light-emitting diodes (LEDs), dimmable LEDs, daylight LEDs, daylight balanced LEDs, flicker free LEDs, bi-colored LEDs, tri-colored LEDs, organic light-emitting diodes (OLEDs), fluorescent light bulbs, incandescent light bulbs, arc lamps, gas discharge lamps, neon lamps, flood lamps, lasers, sulfur lamps, photographic flashes, halogen light sources, and any other light source considered suitable for a particular embodiment. Examples of structural arrangements considered suitable for a light source include those that define a partial, or complete, cylinder, triangular prism, rectangular prism, hexagonal prism, or any other prism, that defines an opening sized and configured to receive a portion, or the entirety, of a support arm, and any other structural arrangement considered suitable for a particular embodiment. In the illustrated embodiment, the light source 18 comprises a LED array 112 attached to an annular ring-shaped printed circuit board 114 that defines a complete cylinder having an opening 115 that is sized and configured to receive a portion of the support arm 16.

A light source included in an illumination device can have any suitable energy consumption, any suitable brightness, and any suitable temperature (i.e., color). Selection of a suitable light source having a particular energy consumption, brightness, and color can be based on various considerations, including the intended use of the illumination device of which the light source is a component. Examples of suitable levels of energy consumption for a light source include those that are greater than, less than, equal to, or about 10 watts, 11 watts, 12 watts, 13, watts, 14 watts, 15 watts, 16 watts, 17 watts, 30 watts, 45 watts, 75 watts, 100 watts, between about 10 watts and about 17 watts, between about 12 watts and about 15 watts, and any other level considered suitable for a particular embodiment. Examples of levels of brightness considered suitable include those in that are greater than, less than, equal to, or about 700 lumens, 800 lumens, 900 lumens, and any other brightness considered suitable for a particular embodiment. Examples of temperatures considered suitable for a light source included in an illumination device include those that are greater than, less than, equal to, or about 3200 Kelvin, 5400 Kelvin, 5500 Kelvin, 5600 Kelvin, 5700 Kelvin, 5800 Kelvin, between about 2700 Kelvin and about 3000 Kelvin, between about 3500 Kelvin and about 4100 Kelvin, between about 5000 Kelvin and about 6500 Kelvin, between about 5400 Kelvin and about 5600 Kelvin, and any other temperature considered suitable for a particular embodiment.

Any suitable technique or method of attaching a light source to a frame and of operatively connecting a light source to a switch can be included in an illumination device and selection of a suitable technique or method can be based on various considerations, including the type of light source and/or switch included in an illumination device. Examples of techniques and methods of attachment considered suitable between a light source and a frame include welding, spot welding, fusing, using fasteners, using threaded fasteners, using adhesives, and any other technique or method considered suitable for a particular embodiment. In the illustrated embodiment, the light source 18 is attached to the frame 14 using multiple threaded fasteners. Examples of techniques and methods considered suitable to operatively connect a light source to a switch include using conductive wires, fuses, combinations of the structures and components described herein, and any other structure and/or component considered suitable for a particular embodiment. In the illustrated embodiment, each LED of the LED array 112 is attached to the printed circuit board 114 by two parallel conductive leads which extend downward from a base of the body of each LED. The LED array 112 is operatively attached to the switch 20 using conductive wires 116 that are attached to and extend from the LED array 112 through the frame first passageway 82 into the frame chamber 80, through the frame second passageway 84, through the frame support second passageway 62 into the frame support chamber 67, through the frame support first passageway 60 and into the elongate shaft passageway 46, through the elongate shaft passageway 46 into the stand chamber 38, and to the switch 20. While a particular technique and method of operatively attaching a light source to a switch has been illustrated, any suitable technique or method of operatively connecting a light source to a switch can be utilized. Selection of a suitable technique or method can be based on various considerations, including the type of light source and/or switch included in an illumination device. Examples of techniques or methods of operatively connecting a light source to a switch include using any suitable path through the various components of an illumination device such that a light source is operatively connected to a switch, welding, spot welding, fusing, using fasteners, using threaded fasteners, and any other technique or method considered suitable for a particular embodiment.

Any suitable number of light sources can be included in an illumination device and selection of a suitable number of light sources can be based on various considerations, including the intended use of an illumination device of which the light source is a component. Examples of numbers of light sources considered suitable to include in an illumination device include zero, one, at least one, two, a plurality, three, four, five, six, and any other number considered suitable for a particular embodiment.

The switch 20 is operatively connected to the light source 18, is adapted to be operatively connected to a power source, and is movable between an open configuration and a closed configuration. The switch 20 includes a control unit 118 that is disposed within the stand chamber 38 and a knob 120. The knob 120 is attached to a portion of the control unit 118 that extends through an opening in the stand 26 to an environment exterior to the base chamber 38. The knob 120 is movably attached to the control unit 118 between a first position and a second position. When the knob 120 is in the first position, the switch 20 is in the open configuration and a circuit within the control unit 118 opens the connection between the light source 18 and a power source such that the light source 18 is in the off state. When the knob 120 is in the second position, the switch 20 is in the closed configuration and the circuit within the control unit 118 closes the connection between the light source 18 and a power source such that the light source 18 is in the on state.

Any suitable technique or method of releasably attached a switch to a stand main body can be utilized and selection of a suitable technique or method can be based on various considerations, including the material that forms a switch. Examples of techniques and methods of attachment considered suitable between a switch and a stand main body include using fasteners, using threaded fasteners, adhesives, fusing, welding, and any other technique or method considered suitable for a particular embodiment. In the illustrated embodiment, threaded fasteners 117 are utilized to releasably attach the switch 20 to the stand main body 34.

While switch 20 has been illustrated as including a control unit 118 and a knob 120, a switch included in an illumination device can comprise any suitable type of switch, that includes any suitable number and type of components, and that is capable of moving a light source between an on state and an off state, or to a position between an on state and an off state. Selection of a suitable switch to include in an illumination device can be based on various considerations, including the type of light source included in the illumination device. Examples of switches considered suitable to include in an illumination device include toggle switches, paddle switches, dimmer switches, timer switches, occupancy switches, vacancy switches, touch switches, touch switches that are configured to move a light source between an off state and an one or more on states (e.g., first on state 25% power, second on state 50% power, third on state 75% power, fourth on state 100% power), and any other switch considered suitable for a particular embodiment. In embodiments in which a switch is a touch switch, the touch switch can be attached to a base such that a user can cycle through the various power levels by touching the base.

A switch included in an illumination device can be operatively connected to a power source using any suitable structure and/or components and selection of suitable structures and/or components can be based on various considerations, including the type of light source included in the illumination device and/or the type of switch include in the illumination device. Examples of structures and/or components considered suitable to include in an illumination device to operatively connect a switch to a power source include conductive wires, fuses, conventional electric adaptors that are sized and configured to be plugged into an electric outlet, DC adaptors, AC adaptors, AC/DC adaptors, combinations of the structures and components described herein, and any other structure and/or component considered suitable for a particular embodiment. A switch can be operatively connected to any suitable power source and selection of a suitable power source can be based on various considerations, including the type of light source included on an illumination device. Examples of power sources considered suitable for a switch to be operatively attached include energy storage devices capable of storing electrical energy and providing electrical energy to a light source, such as batteries, single use batteries, rechargeable batteries, lithium ion batteries, capacitors, ultracapacitors, replaceable power sources, conventional outlets, and any other power source considered suitable for a particular embodiment. Any of the example structures and/or components to operatively connect a switch to a power source and/or any of the example power sources described herein can be included in an illumination device and housed within any suitable portion of an illumination device, such as a base chamber, a chamber cooperatively defined by a frame and a lens, and any other portion of an illumination device considered suitable for a particular embodiment. For example, an illumination device can include an energy storage device, an AC adaptor, and/or a DC adaptor stored in a chamber (e.g., base chamber) that are operatively connected to the light source. In the illustrated embodiment, the switch 20 is adapted to be operatively attached to an external power source (e.g., a wall outlet) using power cord 119 that includes a conventional adaptor 121 that is sized and configured to be disposed within a conventional electrical outlet. In embodiments in which an illumination device includes an internal energy storage device, the illumination device can optionally include one or more light sources operatively attached to the energy storage device and disposed on a base or a frame that indicate the status of the power stored by the energy storage device. In embodiments in which an illumination device includes an internal energy storage device, the energy storage device can be operatively attached to an adaptor (e.g., DC adaptor, AC adaptor) such that it can be attached to an external power source for charging and can be housed within a base chamber, within a chamber defined by a frame support, within a frame chamber, within a recess defined by a frame, within a chamber cooperatively defined by a frame and a lens, or at any other location considered suitable for a particular embodiment.

While the switch 20 has been illustrated as being attached to the base 10, a switch can be attached to any suitable portion of an illumination device and selection of a suitable portion of an illumination device to attach a switch can be based on various considerations, including the location of a light source included in the illumination device. Examples of locations considered suitable to attach a switch include on a base, a frame support, a frame, a support arm, a light source, and any other location considered suitable for a particular embodiment.

Optionally, any of the illumination devices described herein can include one or more communication devices that are operatively attached to a switch, a light source, and/or a power source. The one or more communication devices can include any device adapted to communicate with an electronic device that also includes a communication device, such as wireless networking technology (e.g., Wi-Fi, Bluetooth) or other communications functionalities. The inclusion of one or more communication devices within an illumination device provides a mechanism for manipulating the brightness and/or temperature of a light source using an electronic device (e.g., through a mobile app). Examples of types of communications devices considered suitable to include in an illumination device include wireless networking technology (e.g., Wi-Fi, Bluetooth) or other communications functionalities, and any other electronic device considered suitable for a particular embodiment.

A base, a frame support, a frame, a support arm, and a switch included in an illumination device can be formed of any suitable material and manufactured using any suitable technique or method of manufacture. Selection of a suitable material and technique or method of manufacture can be based on various considerations, including the structural arrangement of the illumination device of which the feature is a component. Examples of materials considered suitable to form a base, a frame support, a frame, a support arm, and/or a switch include wood, polymers, plastics, metals, aluminum, materials that reduce interference with wireless networking technology (e.g., Wi-Fi, Bluetooth), magnetic materials, materials that can be made magnetic, combinations of the materials described herein, and any other material considered suitable for a particular embodiment. Examples of techniques and methods of manufacture considered suitable to form a base, a frame support, a frame, a support arm, and/or a switch include injection molding, casting, and any other technique considered suitable for a particular embodiment.

The illumination devices described herein provide a mechanism for utilizing an electronic device while also utilizing a light source that provides a user with adequate lighting during use of the electronic device. Furthermore, embodiments that include a mirror, such as illumination device 208, provide a user with both a mechanism for viewing their appearance utilizing the mirror and a mechanism for using an electronic device attached to a support arm while the light source provides light.

Optionally, while not illustrated, illumination device 8 can include a mirror that is sized and configured to be releasably attached to the frame 14 (e.g., can be removed from the frame with damaging the mirror or the frame). When included in an illumination device, the frame of the illumination device is movable between a first configuration, a second configuration, and a third configuration. In the first configuration, the support arm and the mirror are free of attachment to the frame. In the second configuration, the support arm is releasably attached to the frame independent of the mirror. In the third configuration, the mirror is releasably attached to the frame independent of the support arm. A mirror can be releasably attached to a frame using any suitable structure, technique, or method of attachment, as described in more detail herein. For example, a mirror can include a casing and a reflective surface. The casing can define a projection that is sized and configured to be received by a frame recess (e.g., frame third recess) such that the mirror can become releasably attached to the frame when the projection is disposed within the frame recess.

Optionally, any of the illumination devices described herein can include a port (e.g., a universal serial bus (USB) port) that can be configured to permanently or removably receive a connector coupled with a wire or cable and can be utilized for various purposes. For example, in embodiments in which an illumination device includes an internal energy storage device, a port included in the illumination device can be operatively connected to the energy storage device such that a conventional electric adaptor plugged into an electric outlet can be used to recharge the energy storage device using the port. Alternatively, in embodiments in which an illumination device includes an internal energy storage device and/or is directly attached to a power source using a conventional electric adaptor via an electric outlet, a port included in the illumination device can be operatively connected to the energy storage device and/or the power source and can be used to charge an electronic device, such as those described herein, during use with an illumination device, or when the electronic device is not being used within an illumination device.

FIGS. 3, 4, 5, 6, 7, and 8 illustrate another example illumination device 208. The illumination device 208 is similar to the illumination device 8 illustrated in FIGS. 1 and 2 and described above, except as detailed below. In the illustrated embodiment, the illumination device 208 includes a base 210, a frame support 212, a frame 214, a support arm 216, a light source 218, a switch 220, a lens 326, a mirror 328, and a port 330.

In the illustrated embodiment, the base 210 includes an adjustment collar 334 and the stand 226 and the elongate shaft 228 are separate members that are releasably attachable to one another using the adjustment collar 334. The stand main body 234 defines a plurality of projections 336 and a shaft exterior thread 337. The plurality of projections 336 are disposed at the stand second end 232 and are sized and configured to receive a portion of the elongate shaft 228. The adjustment collar 334 has an adjustment collar main body 338 that defines an adjustment collar passageway 340 and an adjustment collar interior thread 341. The adjustment collar passageway 340 is sized and configured to receive a portion of the elongate shaft 228 and the adjustment collar interior thread 341 is sized and configured to mate with the shaft exterior thread 337. The adjustment collar 334 is moveable between a first configuration, in which the adjustment collar 334 is free of the plurality of projections 336, and a second configuration, in which the adjustment collar 334 is attached to the plurality of projections 336 and tightened onto the plurality of projections 336 using threads 337, 341. When the elongate shaft 228 is disposed through the adjustment collar passageway 340 and the plurality of projections 336 and the adjustment collar 334 is in the first configuration, the elongate shaft 228 is moveable relative to the stand 226 (e.g., about a lengthwise axis, along a lengthwise axis). When the elongate shaft 228 is disposed through the adjustment collar passageway 340 and the plurality of projections 336 and the adjustment collar 334 is in the second configuration, the elongate shaft 228 is fixed relative to the stand 226. This structural arrangement provides a mechanism for including a telescoping elongate shaft 228 on the illumination device 208.

An adjustment collar can be formed of any suitable material and manufactured using any suitable technique or method of manufacture. Selection of a suitable material and technique or method of manufacture can be based on various considerations, including the structural arrangement of the illumination device of which the adjustment collar is a component. Examples of materials considered suitable to form an adjustment collar include wood, polymers, plastics, rubber, metals, aluminum, materials that reduce interference with wireless technology (e.g., Wi-Fi, Bluetooth), combinations of the materials described herein, and any other material considered suitable for a particular embodiment. Examples of techniques and methods of manufacture considered suitable to form an adjustment collar include injection molding, casting, and any other technique or method considered suitable for a particular embodiment.

Figure 7:
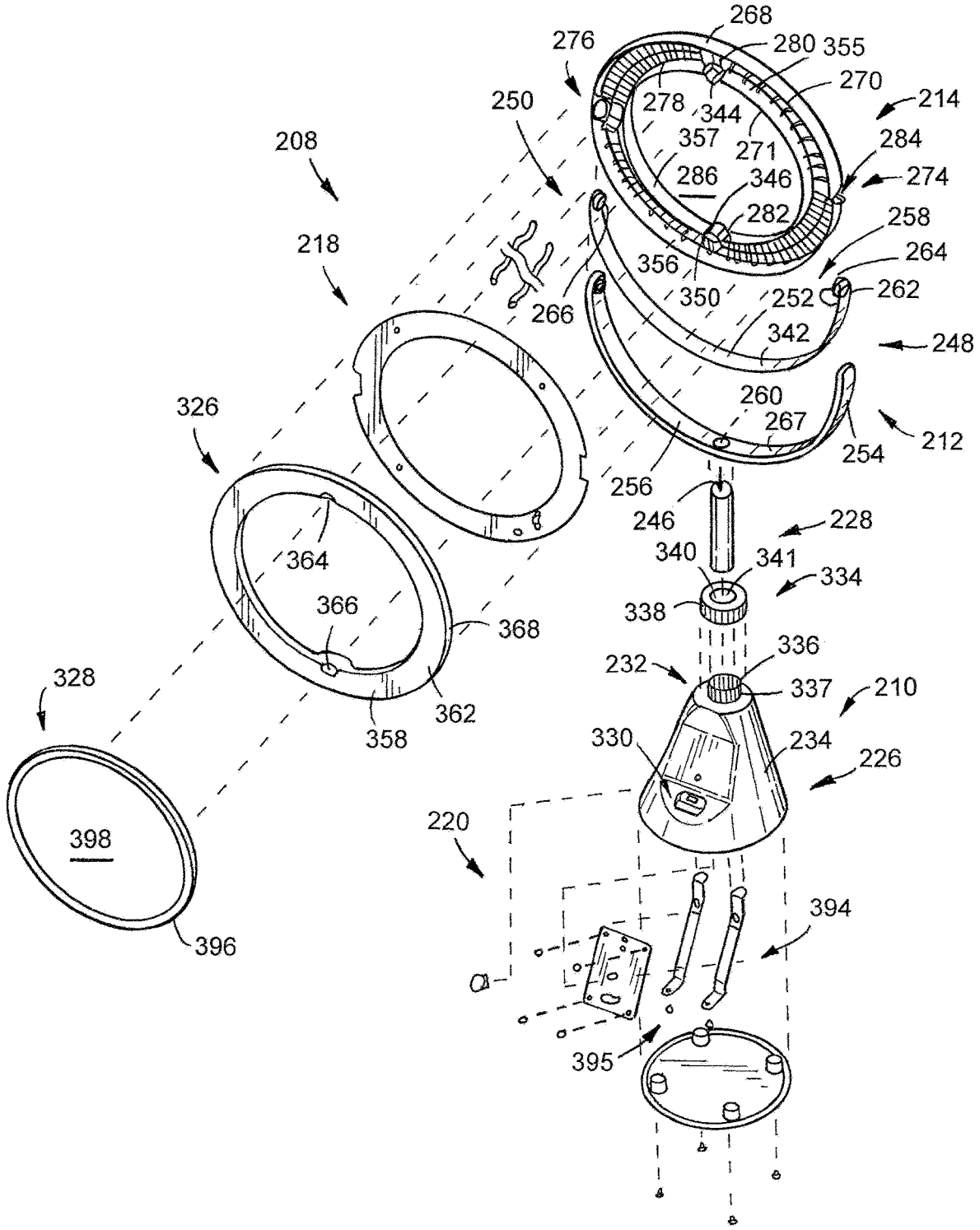
FIG. 7 is an exploded perspective view of the illumination device illustrated in FIG. 3.
Figure 8:
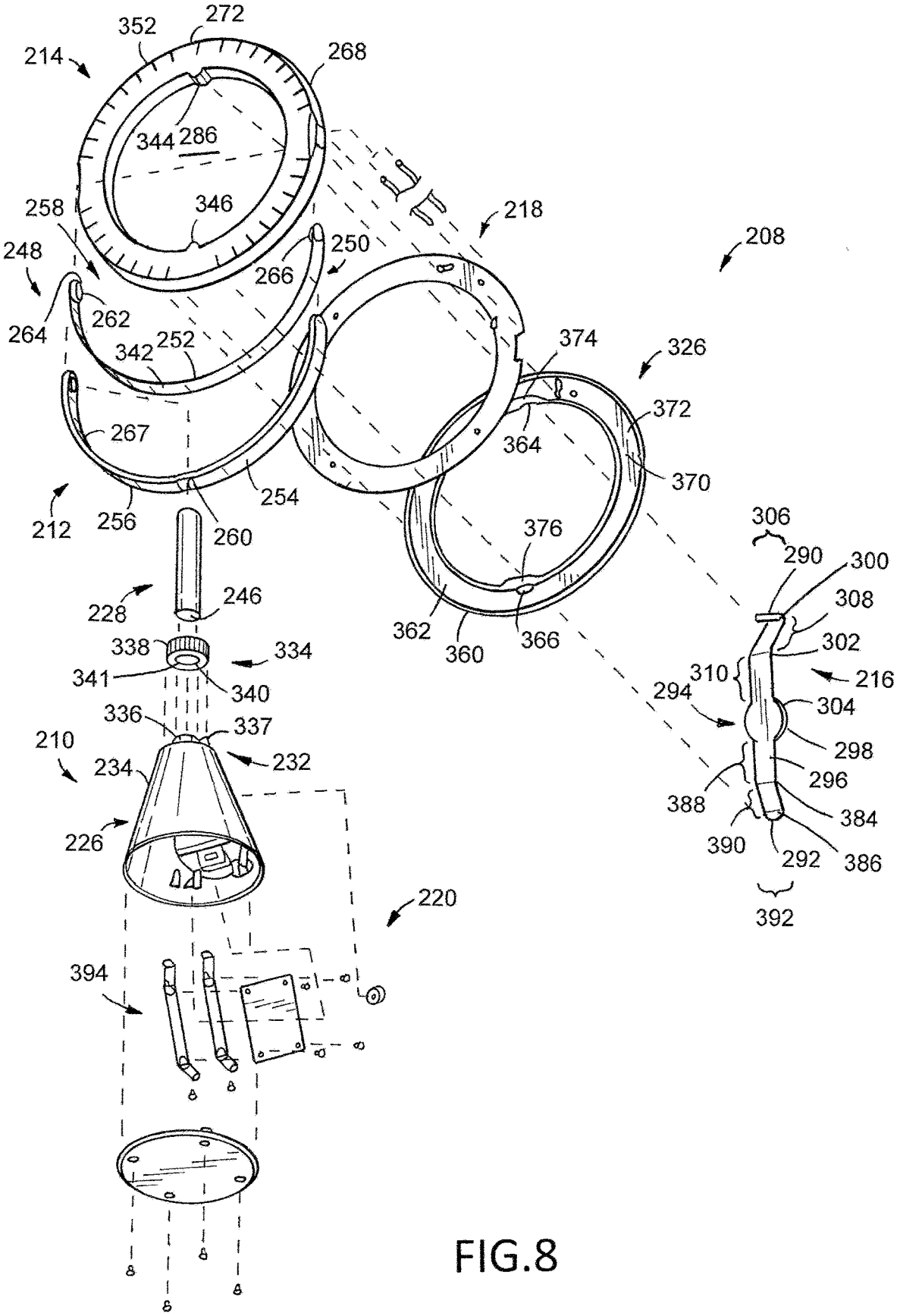
FIG. 8 is an exploded perspective view of the illumination device illustrated in FIG. 5.

In the illustrated embodiment, the frame support 212 comprises a frame support first main body 256 and a frame support second main body 342 that is releasably attached to the frame support first main body 256. As illustrated in FIGS. 7 and 8, the frame support 212 has a frame support first end 248, a frame support second end 250, a frame support first surface 252 on the frame support second main body 342, a frame support second surface 254 on the frame support first main body 256, a frame support opening 258, a frame support first passageway 260, a frame support second passageway 262, a frame support first projection 264, a frame support second projection 266, and a frame support chamber 267. The frame support opening 258 is sized and configured to receive a portion of the frame 214. The frame support first passageway 260 is defined on the frame support second surface 254, extends through the frame support first main body 256, and provides access to the frame support chamber 267. The frame support second passageway 262 is defined on the frame support first projection 264, extends through the frame support second main body 342, and provides access to the frame support chamber 267. Each of the frame support first projection 264 and the frame support second projection 266 is defined by the frame support second main body 342, extends from the frame support first surface 252 and away from the frame support second surface 254, and is sized and configured to be received by a recess 274, 276 defined by the frame 214. In the illustrated embodiment, the frame support 212 is attached to the base 210 (e.g., directly attached to the elongate shaft 228) between the frame support first end 248 and the frame support second end 250 such that the frame support chamber 267 is in communication with the elongate shaft passageway 246 via the frame support first passageway 260.

In the illustrated embodiment, the frame support first main body 256 and frame support second main body 342 are releasably attached to one another using a snap fit attachment. While a particular type of attachment between the frame support first main body 256 and frame support second main body 342 has been illustrated, a frame support first main body and a frame support second main body can be attached to one another using any suitable technique or method of attachment. Selection of a suitable technique or method of attachment between a frame support first main body and a frame support second main body can be based on various considerations, including the type of components being housing within a frame support. Examples of techniques and methods of attachment considered suitable between a frame support first main body and a frame support second main body include using adhesives, welding, fusing, snap fit attachments, threaded fasteners, and any other technique or method considered suitable for a particular embodiment.

Figure 3:
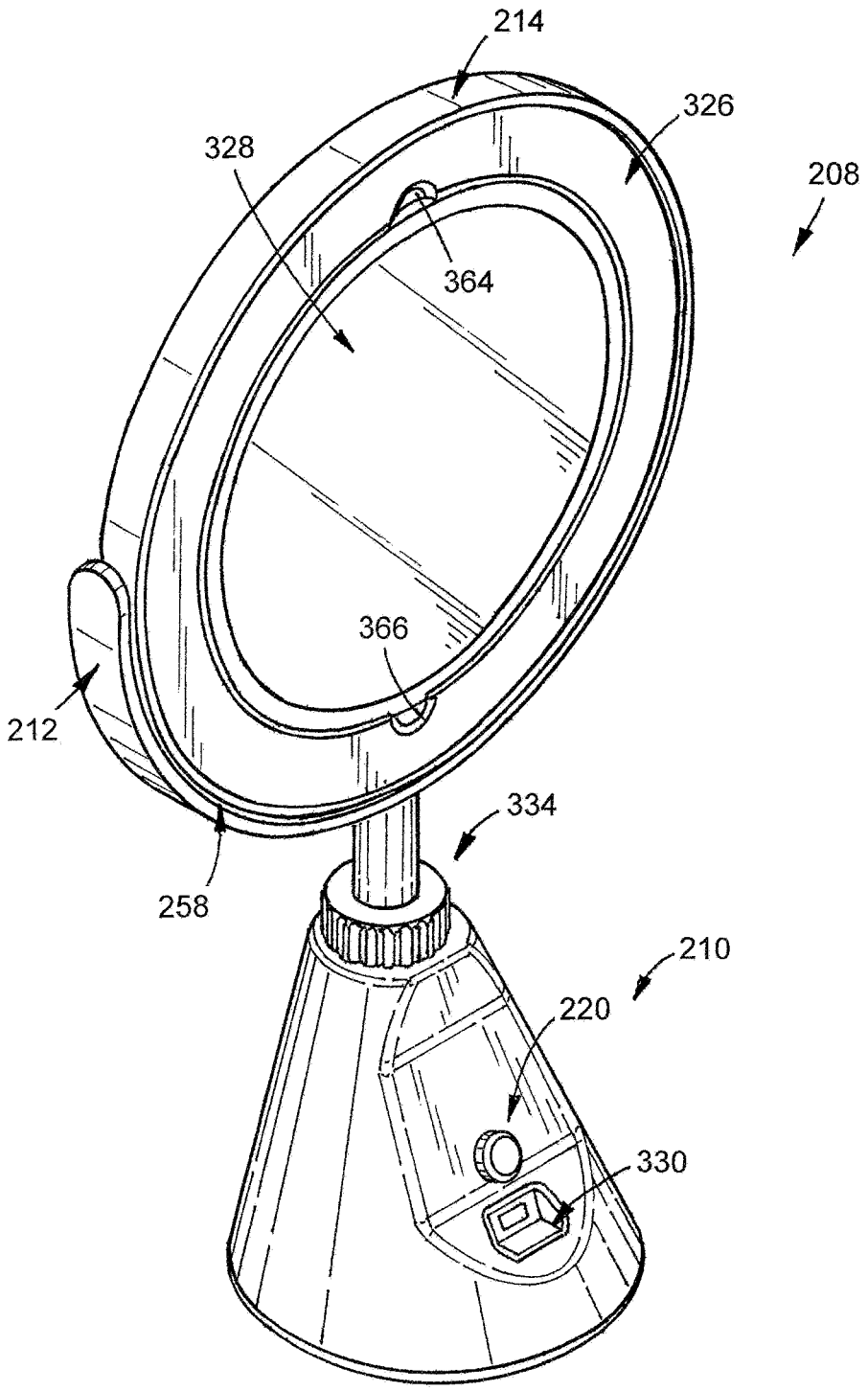
FIG. 3 is a perspective view of a second example illumination device. A mirror is releasably attached to the illumination device.
Figure 4:
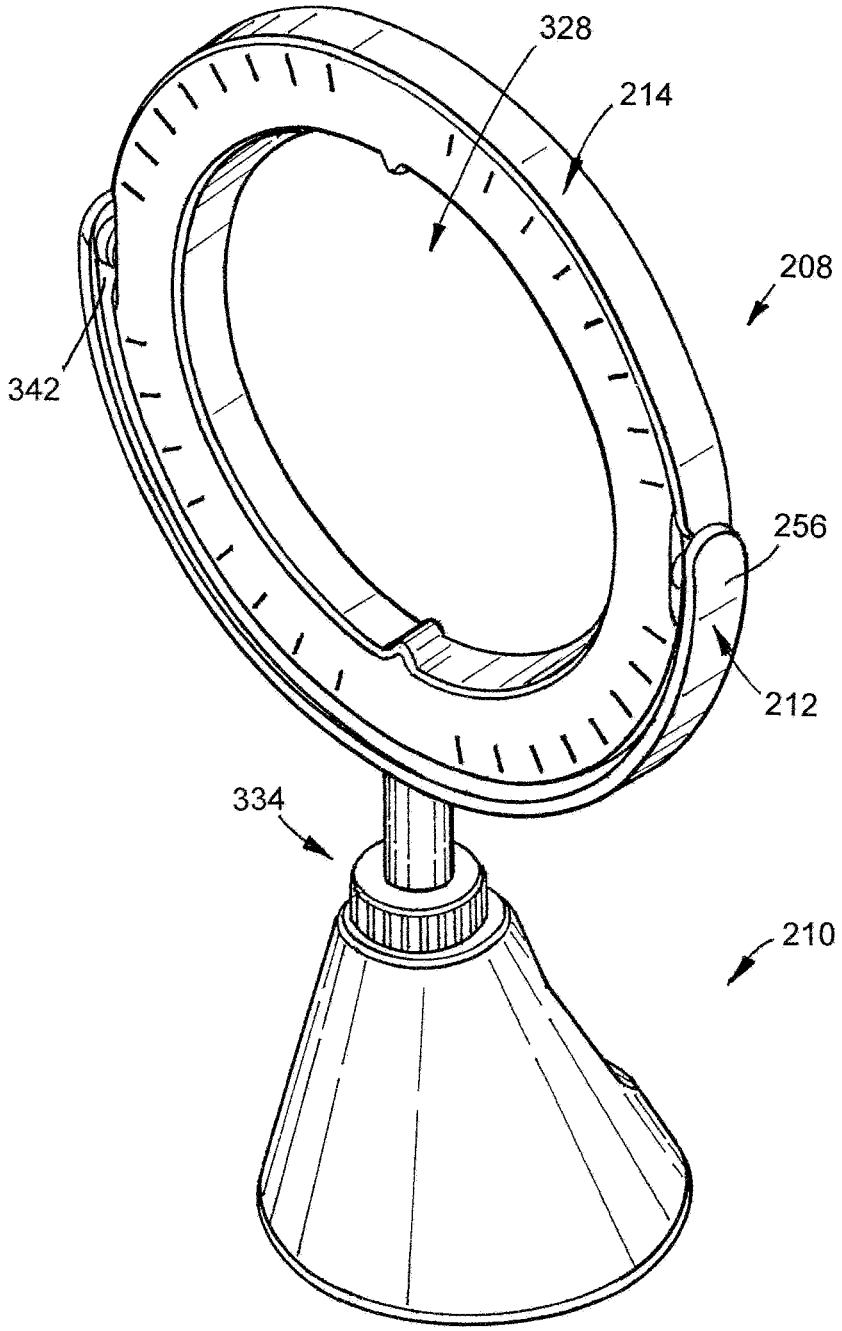
FIG. 4 is another perspective view of the illumination device illustrated in FIG. 3.
Figure 5:
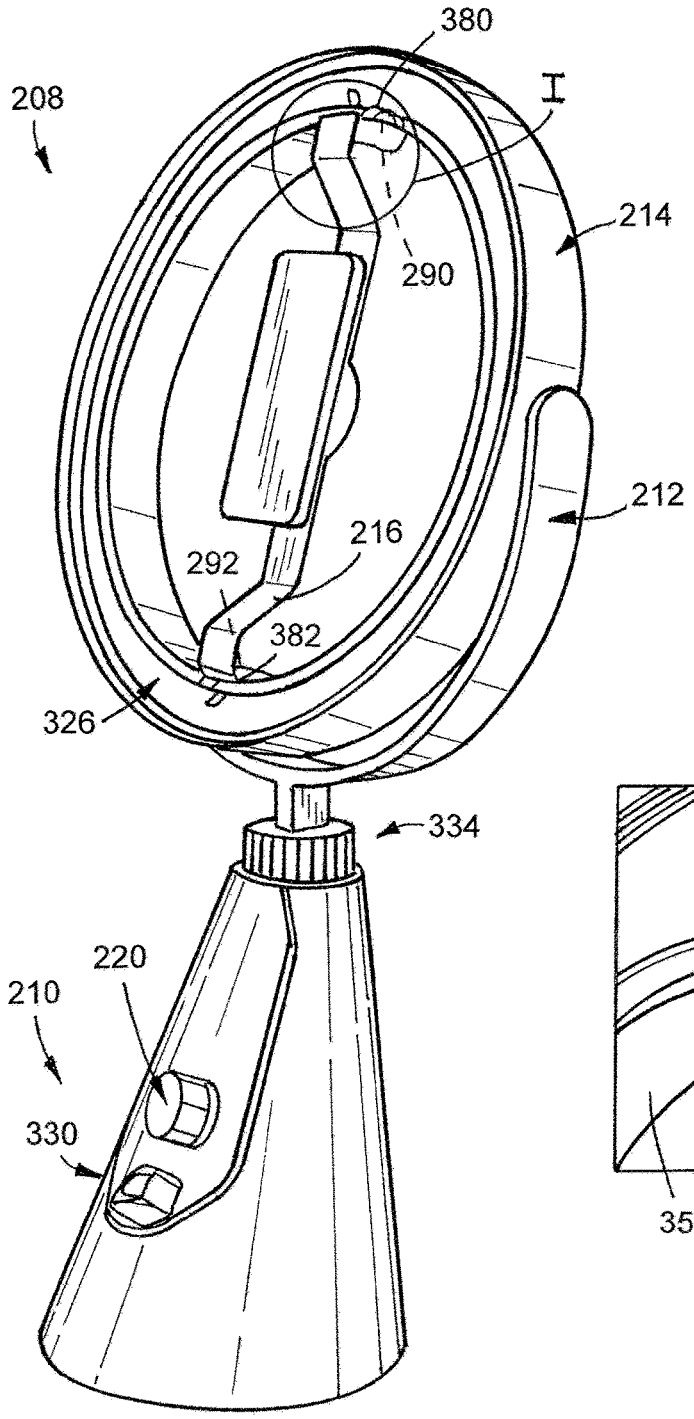
FIG. 5 is another perspective view of the illumination device illustrated in FIG. 3. The mirror has been removed from the illumination device and a support arm and an electronic device are releasably attached to the illumination device.

In the illustrated embodiment, the frame 214 is rotatably attached to the frame support 212, is partially disposed within the frame support first opening 258, and is movable between a first configuration, a second configuration, and a third configuration. In the first configuration, the support arm 216 and the mirror 328 are free of attachment to the frame 214. In the second configuration, the support arm 216 is releasably attached to the frame 214 independent of the mirror 328, as shown in FIG. 5. In the third configuration, the mirror 328 is releasably attached to the frame 214 independent of the support arm 216, as shown in FIGS. 3 and 4.

Figure 6:
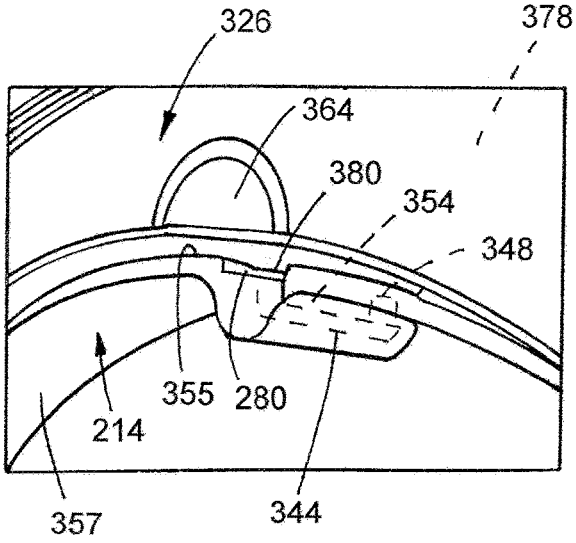
FIG. 6 is a magnified view of area I illustrated in FIG. 5 with the support arm removed from the frame.

As illustrated in FIGS. 6, 7, and 8, the frame 214 has a frame main body 268, a frame first magnet 354, and a frame second magnet 356. The frame main body 268 defines a frame first front surface 270, a frame second front surface 271, a frame back surface 272, a frame first recess 274, a frame second recess 276, a frame third recess 278, a frame first notch 280, a frame second notch 282, a frame first passageway 284, a frame opening 286, a frame first projection 344, a frame second projection 346, a frame fourth recess 348, a frame fifth recess 350, and a plurality of frame slots 352. The frame first front surface 270 is disposed on the outside diameter of the frame 214 and on a first plane that extends orthogonally relative to an axis that contains the center of the frame 214. The frame second front surface 271 is disposed on the inside diameter of the frame 214 and on a second plane that extends orthogonally relative to an axis that contains the center of the frame 214. The second plane is disposed between the first plane and a third plane that contains the frame back surface 272.

The frame third recess 278 extends from the frame front surface 270 toward the frame back surface 272 and is sized and configured to receive a portion of a light source 218 and house portions of various components that operatively connect the light source 218 to the switch 220, as described in more detail herein. In the illustrated embodiment, the frame third recess 278 is an annular recess. Each of the frame first notch 280 and the frame second notch 282 extends from the frame second front surface 271 toward the frame back surface 272, from a frame inner surface 355, and is sized and configured to receive a portion of the support arm 216. The frame first notch 280 extends into the frame first projection 344 and the frame second notch 282 extends into the frame second projection 346. In the illustrated embodiment, each of the frame first notch 280 and the frame second notch 282 is disposed on an axis that extends through the center of the frame 214 and is orthogonal to the axis that contains the frame first recess 274 and the frame second recess 276. The frame first passageway 284 extends through the frame main body 268 within the frame first recess 274 and provides access to the frame third recess 278. The frame opening 286 extends from the frame second front surface 271 to the frame back surface 272 and is sized and configured to receive a portion of a support arm 216 and/or a mirror 328, as described in more detail herein.

Each of the frame first projection 344 and the frame second projection 346 extends from a frame exterior surface 357 and into the frame opening 286. The frame fourth recess 348 extends into the frame first projection 344 from the frame inner surface 355 and the frame fifth recess 350 extends into the frame second projection 346 from the frame inner surface 355. Each of the frame first projection 344 and the frame second projection 346 is disposed on an axis that extends through the center of the frame 214 and is orthogonal to the axis that contains the frame first recess 274 and the frame second recess 276. The frame fourth recess 348 is sized and configured to receive the frame first magnet 354 and the frame fifth recess 350 is sized and configured to receive the frame second magnet 356. The frame first magnet 354 is disposed within the frame fourth recess 348 and the frame second magnet 356 is disposed within the frame fifth recess 350. Each of the frame fourth recess 348 and the frame fifth recess 350 is disposed on an axis that extends through the center of the frame 214 and is orthogonal to the axis that contains the frame first recess 274 and the frame second recess 276. Each slot of the frame plurality of slots 352 extends from the frame back surface 272, through the frame main body 268, to the frame third recess 278 and provides a mechanism for ventilating the frame third recess 278 during use of the illumination device 208.

While the frame 214 has been illustrated as having a first configuration, a second configuration, and a third configuration, a frame can have any suitable number of configurations and selection of the number of configurations for a frame can be based on various considerations, including the structural arrangement of a frame, a mirror, and/or a support arm. For example, a frame, such as frame 214, can alternatively have a fourth configuration in which both the support arm and the mirror are releasably attached to the frame.

Any suitable number and type of magnets can be included in a frame and selection of a suitable number and type of magnets can be based on various considerations, including the type of electronic device intended to be releasably attached to a support arm. Examples of numbers of magnets considered suitable to include on a frame include zero, one, at least one, two, a plurality, three, four, five, and any other number considered suitable for a particular embodiment. Examples of types of magnets considered suitable to attach to a frame include materials that produce a magnetic field, materials that can be made magnetic, materials that can be magnetized, materials that form permanent magnets, ferromagnetic materials, ferrite, permanent magnets, rare-earth permanent magnets, neodymium magnets, and any other magnet considered suitable for a particular embodiment. A magnet included in a frame can be attached to the frame using any suitable technique or method of attachment and selection of a suitable technique or method of attachment between a magnet and a frame can be based on various considerations, including the type of magnet being attached to a frame. Examples of techniques and methods of attachment considered suitable between a magnet and a frame include using adhesives, welding, fusing, snap fit attachments, threaded fasteners, and any other technique or method considered suitable for a particular embodiment.

In the illustrated embodiment, the lens 326 is attached to the frame 214, over the light source 218, and has a lens front surface 358, a lens back surface 360, and a lens main body 362 that defines a lens first recess 364, a lens second recess 366, a lens third recess 368, a lens fourth recess 370, a lens fifth recess 372, a lens first projection 374, and a lens second projection 376. Each of the lens first recess 364 and the lens second recess 366 is disposed on an axis that extends through the center of the lens 326 such that the lens first recess 364 is opposably positioned from the lens second recess 366 relative to the center of the lens 326. Each of the lens first recess 364 and the lens second recess 366 is sized and configured to receive a portion of a human finger such that the frame 214 can be moved between its first, second, and third configurations, as described in more detail herein. When the illumination device is assembled, the lens first recess 364 is disposed adjacent to the frame first notch 280 and the lens second recess 366 is disposed adjacent to the frame second notch 282.

Each of the lens third recess 368 and the lens fourth recess 370 is disposed on an axis that extends through the center of the lens 326 such that the lens third recess 368 is opposably positioned from the lens fourth recess 370 relative to the center of the lens 326. Each of the lens third recess 368 and the lens fourth recess 370 is sized and configured to receive a portion of the frame main body 268 that defines a recess 274, 276. The lens fifth recess 372 extends from the lens back surface 360 toward the lens front surface 358 and is sized and configured to receive a portion of the light source 218. In the illustrated embodiment, the frame third recess 278 and the lens fifth recess 372 cooperatively define a chamber 378 that is sized and configured to house the light source 218, and a portion of the components that operatively attached the light source 218 to the switch 220. Each of the lens first projection 374 and the lens second projection 376 is disposed on an axis that extends through the center of the lens 326 such that the lens first projection 374 is opposably positioned from the lens second projection 376 relative to the center of the lens 326.

As illustrated in FIGS. 5 and 6, the lens 326 cooperatively defines a first slot 380 and a second slot 382 with the frame 214 that are each sized and configured to receive a portion of the support arm 216. For example, the frame first notch 280 and the lens first projection 374 cooperatively define the first slot 380 and the frame second notch 282 and the lens second projection 376 cooperatively define the second slot 382. The first slot 380 is sized and configured to receive a portion of the support arm first end 290 and the second slot 382 is sized and configured to receive a portion of the support arm second end 292.

In the illustrated embodiment, the lens 326 is releasably attached to the frame 214 using a snap fit attachment. While a particular type of attachment between a lens and a frame has been illustrated, a lens can be attached to a frame using any suitable technique or method of attachment. Selection of a suitable technique or method of attachment between a lens and a frame can be based on various considerations, including the material that forms a lens. Examples of techniques and methods of attachment considered suitable between a lens and a frame include using adhesives, welding, fusing, snap fit attachments, threaded fasteners, and any other technique or method considered suitable for a particular embodiment.

A lens included in an illumination device can be formed of any suitable material and have any suitable degree of transparency and/or opaqueness. Selection of a suitable material to form a lens and of a suitable degree of transparency and/or opaqueness to impart on a lens can be based on various considerations, including the intended use of the illumination device of which the lens is a component. For example, a lens can be formed of any suitable material, having any suitable thickness, that is capable of manipulating a characteristic of a light source, such as the brightness, color, or intensity and/or manipulating a characteristic of an environment. Examples of materials considered suitable to form a lens include glass, resin, plastic, gels, polyester, polyester gels, ultra-violet reducing materials, polarizing materials, and any other material considered suitable for a particular embodiment. A lens can incorporate any suitable colored material into the material that forms a lens, such as colored materials that are cyan, yellow, red, blue, green, tungsten, and any other color considered suitable for a particular embodiment.

In the illustrated embodiment, and as illustrated in FIG. 8, the support arm 216 is releasably attached to the frame 214 when the frame is in the second configuration, is formed of a magnetic material to accomplished releasable attachment to the frame 214 using the frame first magnet 354 and the frame second magnet 356, and has a support arm first end 290, a support arm second end 292, a support arm attachment portion 294, a support arm main body 296, and a support arm magnet 298. The support arm main body 296 defines a support arm first bend 300, a support arm second bend 302, a support arm recess 304, a support arm first portion 306, a support arm second portion 308, a support arm third portion 310, a support arm third bend 384, a support arm fourth bend 386, a support arm fourth portion 388, a support arm fifth portion 390, and a support arm sixth portion 392. Each of the support arm first end 290 and the support arm second end 292 is releasably attached to the frame 214. In the illustrated embodiment, the support arm first end 290 is disposed within the first slot 380 and releasably attached to the frame first magnet 354 and the support arm second end 292 is disposed within the second slot 382 and releasably attached to the frame second magnet 356. Each of the slots 380, 382 and the magnets 354, 356 provides a separate mechanism for releasably attaching the support arm 216 to the frame 214.

The support arm first portion 306 extends from the support arm first end 290 to the support arm first bend 300 and has a first width that is sized and configured to be received by the first slot 380. The support arm second portion 308 extends from the support arm first bend 300 to the support arm second bend 302 and has a second width that is equal to the first width. The support arm third portion 310 extends from the support arm second bend 302 to the support arm attachment portion 294. The support arm attachment portion 294, which in the illustrated embodiment includes the support arm recess 304 and the support arm magnet 298, is disposed between the support arm first end 290 and the support arm second end 292. The support arm magnet 298 is sized and configured to accomplish releasable attachment between the support arm 216 and an electronic device such that the position of the electronic device is maintained during use, as illustrated in FIG. 5. The support arm fourth portion 388 extends from the support arm attachment portion 294 to the support arm third bend 384. The support arm fifth portion 390 extends from the support arm third bend 384 to the support arm fourth bend 386 and has a third width. The support arm sixth portion 392 extends from the support arm fourth bend 386 to the support arm second end 292 and has a fourth width that is less than the third width and sized and configured to be received by the second slot 382.

In the illustrated embodiment, each of the support arm first bend 300, the support arm second bend 302, the support arm third bend 384, and the support arm fourth bend 386 is a predefined bend that positions the support arm attachment portion 294 at a location between a first plane that contains the frame first front surface 270 and a second plane that contains the frame back surface 272. The support arm first bend 300 positions the support arm first portion 306 at an acute angle relative to the support arm second portion 308. The support arm second bend 302 positions the support arm second portion 308 at an obtuse angle relative to the support arm third portion 310. The support arm third bend 384 positions the support arm fourth portion 388 at an obtuse angle relative to the support arm fifth portion 390. The support arm fourth bend 386 positions the support arm fifth portion 390 at an acute angle relative to the support arm sixth portion 392. This structural arrangement of the support arm 216 provides a mechanism for attaching an electronic device to the support arm 216 such that the frame 214 is out of view of any recording device (e.g., camera) being used by the electronic device and allows for the light source 218 to be directed toward an individual using the illumination device 208 and the electronic device during use of the illumination device 208 and the electronic device.

In the illustrated embodiment, the light source 218 is disposed within the frame third recess 278 and is operatively connected to the switch 220. The light source 218 is attached to the frame 214, within the frame third recess 278, and between the frame 214 and the lens 326 using multiple threaded fasteners. In the illustrated embodiment, the control unit 318 of the switch 220 is attached to the base 210 using two brackets 394 and a plurality of threaded fasteners 395.

As illustrated in FIG. 7, the mirror 328 is releasably attached to the frame 214 when the frame is in the third configuration and has a mirror casing 396 and a reflective surface 398. The mirror casing 396 surrounds the entire perimeter of the reflective surface 398 and is formed of a magnetic material such that releasable attachment to the frame 214 can be accomplished using the frame first magnet 354 and the frame second magnet 356. When attached to the frame 214, the mirror casing 396 is disposed adjacent to the frame second front surface 271, the frame first projection 344, and the frame second projection 346 such that a first portion of the mirror 328 is disposed within the frame opening 286 and a second portion of the mirror is disposed outside of the frame opening 286. It is considered advantageous to form a casing of a mirror of a magnetic material at least because it provides a mechanism for releasably attaching the mirror to a frame during use.

The casing and a reflective surface of a mirror can be formed of any suitable material and selection of a suitable material can be based on various considerations, including the type of material that forms a frame. Examples of materials considered suitable to form a casing of a mirror include materials that produce a magnetic field, materials that can be made magnetic, materials that can be magnetized, materials that form permanent magnets, ferromagnetic materials, ferrite, permanent magnets, rare-earth permanent magnets, neodymium magnets, zinc-plated steel, and any other material considered suitable for a particular embodiment. Examples of materials considered suitable to form a reflective surface include using conventional techniques or methods to apply a reflective coating (e.g., aluminum, silver, tin, copper, paint) onto suitable substrate (e.g., glass), highly reflective materials, materials that are shatter-resistant, combinations of the materials described herein, and any other material considered suitable for a particular embodiment.

While the mirror casing 396 of the mirror 328 has been illustrated as releasably attached to the frame 214, any suitable portion of a mirror can include structure and/or components that accomplish releasable attachment to a portion of an illumination device. Selection of suitable structure and/or components to include on a mirror can be based on various considerations, including the structural arrangement of a frame, or other component, to which the mirror is intended to be attached. Examples of structures and components considered suitable to releasably attach a mirror to a portion of an illumination device, such as a frame, include using one or more projections and recesses, such as those described with respect to support arm 16 and frame 14 as shown in FIGS. 1 and 2, using one or more projections and slots and one or more magnets, such as those described with respect to support arm 216 and frame 214 as shown in FIGS. 3, 4, 5, 6, 7, and 8, using one or more magnets, using one or more projections and slots, combinations of the structures and components described herein, and any other structure or component considered suitable for a particular embodiment. For example, a casing could alternatively only extend around a portion of a perimeter of a mirror, or have more than one portion such that each portion extends around a portion of a perimeter of a mirror, and each portion of the casing can accomplish releasable attachment between the mirror and a frame, or other component of an illumination device, using magnets included on a frame, or other component of an illumination device.

While the mirror 328 has been illustrated as having a particular structural arrangement and as including a single reflective surface 398, a mirror can have any suitable structural arrangement and include any suitable number of reflective surfaces. Selection of suitable structural arrangement for a mirror included in an illumination device and of a suitable number of reflective surfaces to include on the mirror can be based on various considerations, including the structural arrangement of a frame to which a mirror is intended to be attached. Examples of structural arrangements considered suitable for a mirror include those define a partial, or complete, cylinder, triangular prism, rectangular prism, hexagonal prism, or any other prism, and any other structural arrangement considered suitable for a particular embodiment. In the illustrated embodiment, the mirror 328 defines a complete cylinder. Examples of numbers of reflective surfaces considered suitable to include on a mirror include one, more than one, two, a plurality, three, four, and any other number considered suitable for a particular embodiment. For example, a mirror can have a first reflective surface that has a first magnification (e.g., 1×) and a second reflective surface that is opposably facing the first reflective surface and that has a second magnification (e.g., 8×) that is different than, equal to, greater than, or less than, the first magnification.

While the mirror 328 has been illustrated as being attached to the frame 214 such that a first portion of the mirror 328 is disposed within the frame opening 286 and a second portion of the mirror is disposed outside of the frame opening 286, a mirror can be attached to a frame such that any suitable portion is disposed within a frame opening. For example, a mirror can be attached to a frame such that a first portion of the mirror is disposed within a frame opening and a second portion of the mirror is disposed outside of the frame opening, such that the entire mirror is disposed within a frame opening, such that the entire mirror is disposed outside of a frame opening, or such that a front surface (e.g., reflective surface) of a mirror is flush with a plane that contains a frame front surface.

In the illustrated embodiment, the port 330 is a USB port that is adapted to be operatively connected to a power source, such as those described herein, and is configured to removably receive a connector that is coupled to a cable. The cable can include any suitable adaptor that is sized and configured to be operatively connected to an electronic device such that the electronic device is operatively connected to the power source.

In an alternative embodiment, and depending on the type of light source included in an illumination device, an illumination device can include a ballast that is operatively attached to a light source and a switch and disposed within the base, within a recess defined by a frame, or within a chamber cooperatively defined by a frame and a lens. Any suitable ballast can be included in an illumination device and selection of a suitable ballast can be based on various considerations, including the type of light source included in an illumination device of which the ballast is a component and/or the number of light sources included in the illumination device.

FIGS. 9, 10, 11, 12, 13, 14, and 15 illustrate another example illumination device 408. The illumination device 408 is similar to the illumination device 208 illustrated in FIGS. 3, 4, 5, 6, 7, and 8 and described above, except as detailed below. In the illustrated embodiment, the illumination device 408 includes a base 410, a frame 414, a support arm 416, a light source 418, a switch 420, a lens 526, a mirror 528, and a filter 532.

In the illustrated embodiment, the base 410 has a base first end 422, a base second end 424, a base first stand 426, and a base second stand 428. Each of the base first stand 426 and the base second stand 428 extends from the base first end 422 to the base second end 424 and has a stand main body 434 that defines a mounting plate 436, an elongate shaft 438, and a recess 440. The mounting plate 436 is sized and configured to be mounted on a wall, or any other suitable surface. The elongate shaft 438 extends from the mounting plate 436 to the base second end 424. The recess 440 extends into the stand main body 434 toward the lengthwise axis of the elongate shaft 438 and is sized and configured to receive a portion of the mirror 528.

A mounting plate can be attached to a wall, or other surface, using any suitable technique or method of attachment and selection of a suitable technique or method of attachment can be based on various considerations, including the material that forms the wall, or surface. Examples of techniques and methods of attachment considered suitable to attach a mounting plate to a wall, or other surface, include using anchor bolts, anchor screws, nails, threaded fasteners, combinations of the techniques and methods described herein, and any other technique or method of attachment considered suitable for a particular embodiment.

Figure 10:
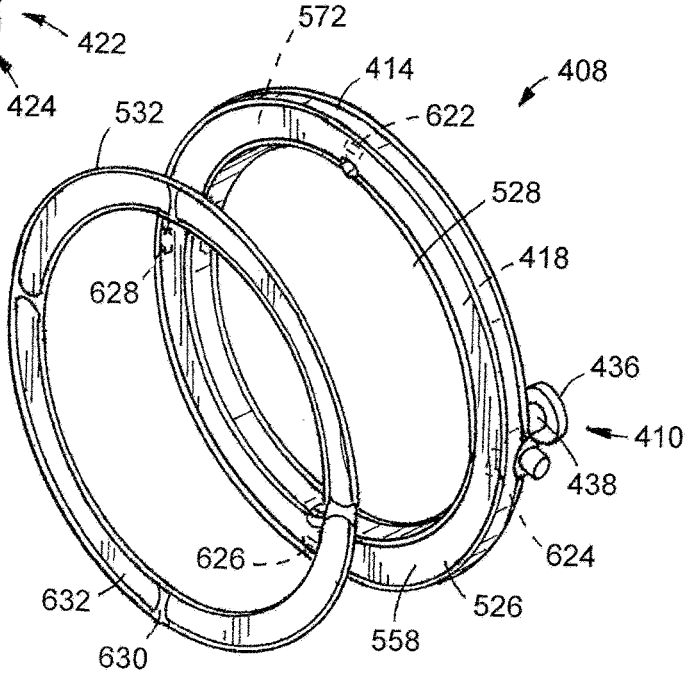
FIG. 10 is a partially exploded perspective view of the illumination device illustrated in FIG. 9.
Figure 10A:
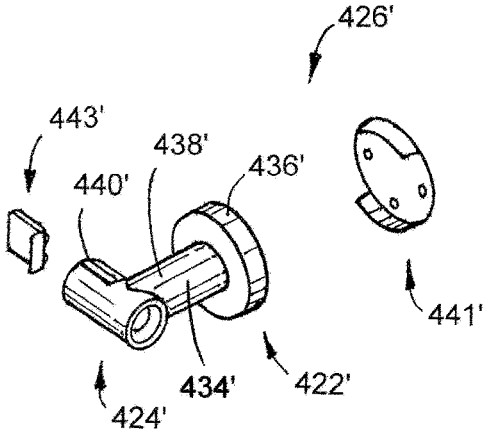
FIG. 10A is an exploded perspective view of an alternative base stand that can be included in an illumination device.

While the base 410 has been illustrated as including a base first stand 426 and a base second stand 428, each having a particular structural arrangement, a base can include any suitable number of base stands having any suitable structural arrangement. For example, as illustrated in FIG. 10A, an alternative base stand 426' extends from the base first end 422' to the base second end 424' and has a stand main body 434' that defines a mounting plate 436', an elongate shaft 438', and a recess 440'. In the illustrated embodiment, the mounting plate 436' is sized and configured to be disposed within and releasably attached to a wall mounting plate 441' that is sized and configured to be mounted on a wall, or any other suitable surface (e.g., using one or more fasteners). In addition, the recess 440' extends into the stand main body 434' toward the lengthwise axis of the elongate shaft 438' and is sized and configured to receive a portion of a mirror and a clip 443'. The clip 443' is sized and configured to be received within the recess 440' and provides releasable attachment between the base stand 426' and a mirror. Selection of a suitable number of base stands to include in an illumination device, and of a suitable structural arrangement for a base stand, can be based on various considerations, including the structural arrangement of a mirror intended to be attached to a base. Examples of numbers of base stands considered suitable to include in a base include one, at least one, two, a plurality, three, four, five, six, and any other number considered suitable for a particular embodiment.

Figure 9:
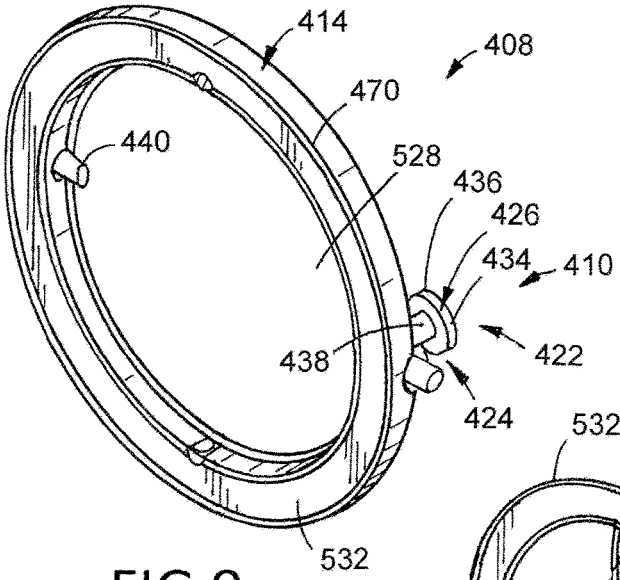
FIG. 9 is a perspective view of a third example illumination device.
Figure 11:
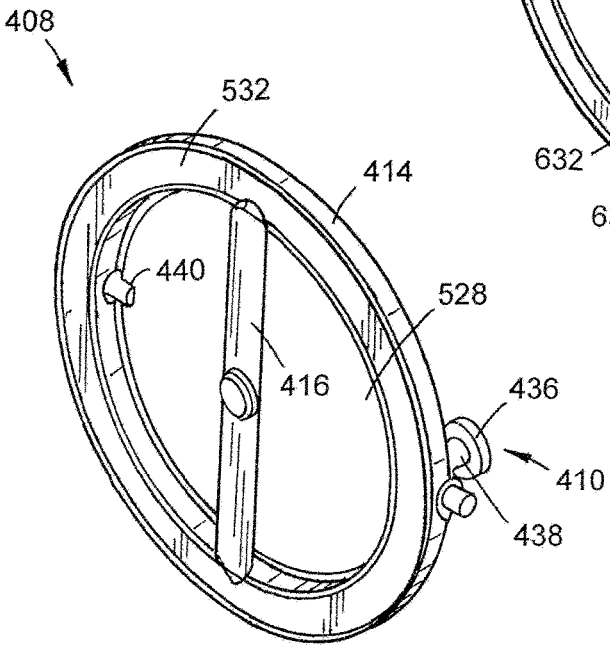
FIG. 11 is a perspective view of the illumination device illustrated in FIG. 9. A support arm is releasably attached to the illumination device.
Figure 14:
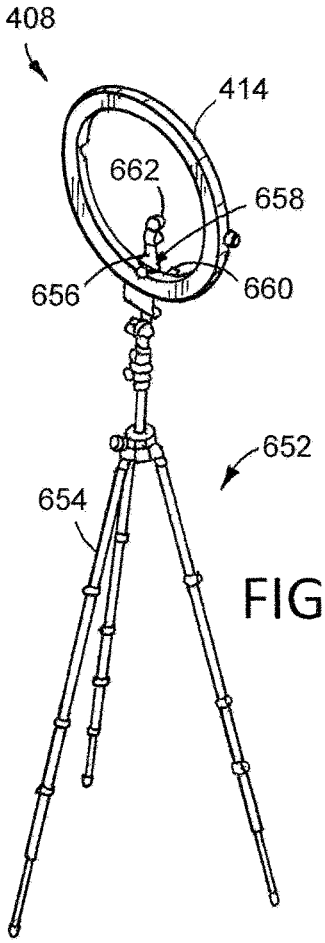
FIG. 14 illustrates the illumination device illustrated in FIG. 12 attached to a stand.
Figure 12:
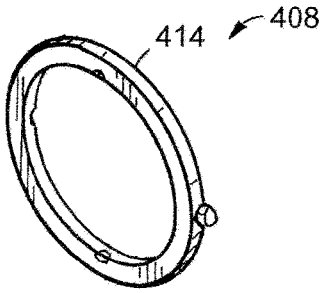
FIG. 12 illustrates the illumination device illustrated in FIG. 9 free of the base.
Figure 15:
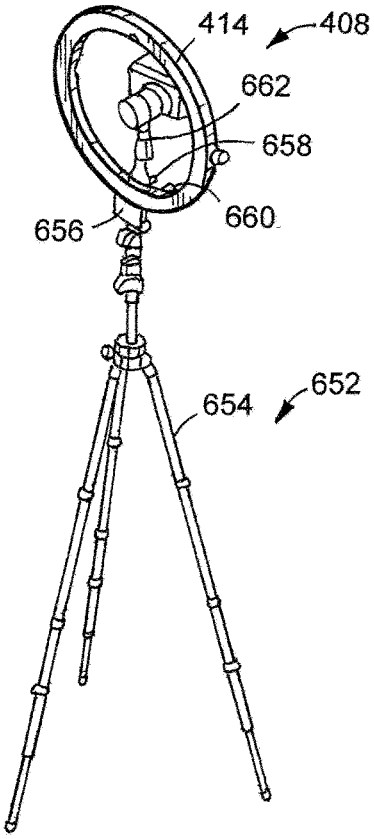
FIG. 15 illustrates the illumination device illustrated in FIG. 12 and a camera attached to a stand.

In the illustrated embodiment, the frame 414 is releasably attached directly to the base 410 and is movable between a first configuration, a second configuration, a third configuration, a fourth configuration, and a fifth configuration. In the first configuration, the frame 414 is free of attachment to the base 410, the support arm 416, and the mirror 528, as illustrated in FIG. 12. In the second configuration, the frame 414 is releasably attached to the base 410 and the mirror 528, as illustrated in FIGS. 9 and 10. In the third configuration, the frame 414 is releasably attached to the base 410 and the mirror 528 and the support arm 416 is releasably attached to the frame 414, as illustrated in FIG. 11. In the fourth configuration, the frame 414 is free of attachment to the base 410 and the support arm 416 is releasably attached to the frame 414. In the fifth configuration, the frame 414 is free of attachment to the base 410 and the support arm 416 and the frame 414 is releasably attached to a tripod 652, as illustrated in FIGS. 14 and 15. The frame 414 can also have additional configurations using various combinations of the configurations described above.

Figure 13:
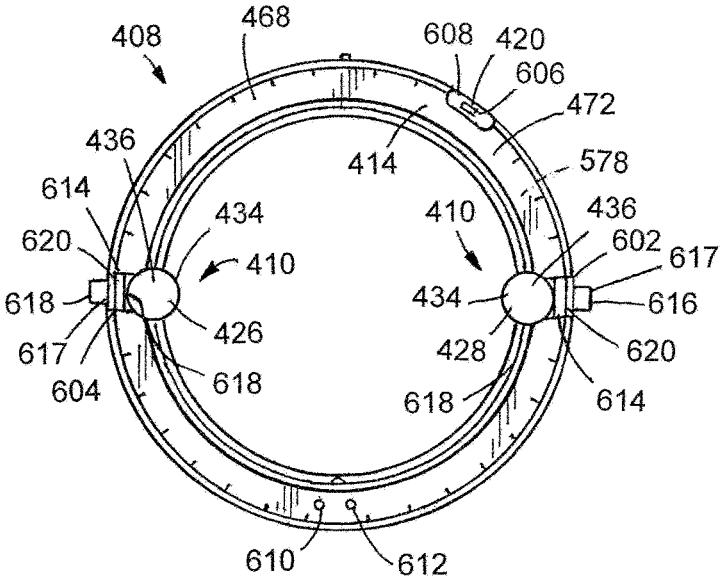
FIG. 13 is a rear view of the illumination device illustrated in FIG. 11.

As illustrated in FIG. 13, the frame main body 468 defines a frame first passageway 602, a frame second passageway 604, a frame third passageway 606, a frame sixth recess 608, a frame fifth passageway 610, and a frame sixth passageway 612 and the frame 414 includes a first fastener 614, and a second fastener 616. Each of the frame first passageway 602, the frame second passageway 604, and the frame third passageway 606 extends through the frame main body 468 and provides access to the chamber 578 cooperatively defined by the frame third recess and the lens fifth recess. Each of the frame first passageway 602 and the frame second passageways 604 is disposed on an axis that extends orthogonally to an axis that contains the center of the frame 414 such that the frame first passageway 602 is opposably positioned from the frame second passageway 604 relative to the center of the frame 414. Each of the frame first passageway 602 and the frame second passageways 604 has an internal thread 614 that is sized and configured to mate with the external thread 620 defined by a fastener 614, 616, as described in more detail herein. The frame third passageway 606 is defined between the frame first passageway 602 and the frame second passageways 604 and extends from the frame back surface 472 toward the frame front surface 470 and provides access to chamber 578. The frame sixth recess 608 is defined around the perimeter of the frame third passageway 606 and is sized and configured to receive a portion of a human finger. Each of the frame fifth passageway 610 and the frame sixth passageway 612 extends through the frame main body 468 from the frame back surface 472 into the frame third recess 478. Each of the frame fifth passageway 610 and the frame sixth passageway 612 is sized and configured to receive a fastener to releasably attach the frame 414 to another component, as described in more detail herein.

As illustrated in FIG. 13, each of the first fastener 614 and the second fastener 616 has a main body 617 that defines an elongate shaft 618 and an external thread 620 that extends along a portion of the elongate shaft 618. The main body 617 and the external thread 620 of each of the first fastener 614 and the second fastener 616 are sized and configured to be received by a passageway 602, 604 defined by the frame 414 and to mate with an internal thread 614 defined by the frame main body 468. Each of the first fastener 614 and the second fastener 616 is movable between a first position and a second position. In the first position, the fastener 614, 616 is free of the passageway 602, 604 and the frame 414 is movable relative to the base 410. In the second position, the fastener 614, 616 is disposed within the passageway 602, 604 such that it contacts a portion of a base stand 426, 428 and the frame 414 is releasably attached to the base 410.

In the illustrated embodiment, the switch 420 is attached to the frame 414, and partially disposed within chamber 578, such that movement of the light source 418 between the on state and the off state 420 can be accomplished by moving the switch between its first and second positions.

In the illustrated embodiment, as shown in FIG. 10, the lens 526 includes a lens first magnet 622, a lens second magnet 624, a lens third magnet 626, and a lens fourth magnet 628. Each of the magnets 622, 624, 626, and 628 is attached to the lens 526 within the lens fifth recess 572 and the chamber 578 and cooperatively are sized and configured to releasably attach the filter 532 to the lens 526. Each of the lens first magnet 622 and the lens second magnet 624 is disposed on an axis that extends orthogonally to an axis that contains the center of the lens 526 such that the lens first magnet 622 is opposably positioned relative to the lens second magnet 624 relative to the center of the lens 528. Each of the lens third magnet 626 and the lens fourth magnet 628 is disposed on an axis that extends orthogonally to an axis that contains the center of the lens 526, and orthogonally to the axis that contains the lens first magnet 622 and the lens second magnet 624, such that the lens third magnet 626 is opposably positioned relative to the lens fourth magnet 628 relative to the center of the lens 528.

While the lens 526 has been illustrated as including four magnets 622, 624, 626, and 628 positioned at particular locations on the lens 526, a lens can include any suitable number of magnets positioned at any suitable location on the lens that achieves releasable attachment of a filter, as described herein. Examples of numbers of magnets considered suitable to include on a lens include one, at least one, two, a plurality, three, four, and any other number considered suitable for a particular embodiment. Examples of techniques and methods of attachment considered suitable between a magnet and a lens include using fasteners, using threaded fasteners, adhesives, fusing, welding, and any other technique or method considered suitable for a particular embodiment. In the illustrated embodiment, each magnet 622, 624, 626, and 628 is attached to the lens 526 using an adhesive.

In the illustrated embodiment, the mirror 528 is releasably attached to the base 410 within the recesses 440 defined by the stand main body 434 of each base stand 426, 428.

The filter 532 comprises a filter casing 630 and a filter main body 632 attached to the filter casing 630. The filter casing 630 surrounds the entire perimeter of the filter main body 632 and is formed of a magnetic material such that releasable attachment to the lens 526 can be accomplished using the lens magnets 622, 624, 626, and 628. When attached to the lens 526, the casing 630 is disposed adjacent to the lens front surface 558 such that a majority, or the entirety, of the filter 526 covers the lens front surface 558. Forming a filter casing of a magnetic material provides a mechanism for releasably attaching the filter to a lens during use.

The filter main body 632 can be formed of any suitable material that is capable of manipulating a characteristic of a light source and/or lens, such as the brightness, color, or intensity and/or manipulating a characteristic of an environment. Examples of materials considered suitable to form a filter main body include glass, resin, plastic, gels, polyester, polyester gels, ultra-violet reducing materials, polarizing materials, and any other material considered suitable for a particular embodiment. A filter can incorporate any suitable colored material into the material that forms a filter main body, such as colored materials that are cyan, yellow, red, blue, green, tungsten, and any other color considered suitable for a particular embodiment. In addition, a filter can optionally include a pattern that allows only a portion of light supplied by a light source to pass through the filter such that the pattern is projected on a surface (e.g., an individual using the illumination device).

A filter casing can be formed of any suitable material and selection of a suitable material can be based on various considerations, including the type of material that forms a filter main body. Examples of materials considered suitable to form a filter casing include materials that produce a magnetic field, materials that can be made magnetic, materials that can be magnetized, materials that form permanent magnets, ferromagnetic materials, ferrite, permanent magnets, rare-earth permanent magnets, neodymium magnets, zinc-plated steel, and any other material considered suitable for a particular embodiment.

As illustrated in FIGS. 14 and 15 in the fifth configuration, the frame 414 is free of attachment to the base 410 and the support arm 416 and the frame 414 is releasably attached to a tripod 652 that includes a stand 654 and a mount 656. The mount 656 is releasably attached to the stand 654 and includes a first fastener 658 and a second fastener 660, and a third fastener 662. Each of the first fastener 658 and the second fastener 660 is sized and configured to pass through an opening defined by the mount 656 and to be receive by a frame passageway 610, 612 such that the frame 414 can be releasably attached to the mount 656. The third fastener 662 is sized and configured to pass through an opening defined by the mount 656 and to be received by a camera, or a camera mount, such that the camera becomes releasably attached to the mount, as shown in FIG. 15. Optionally, an external power source can be attached to the tripod 652 that can provide power to an illumination device and/or any electronic devices attached to the illumination device.

Figure 16:
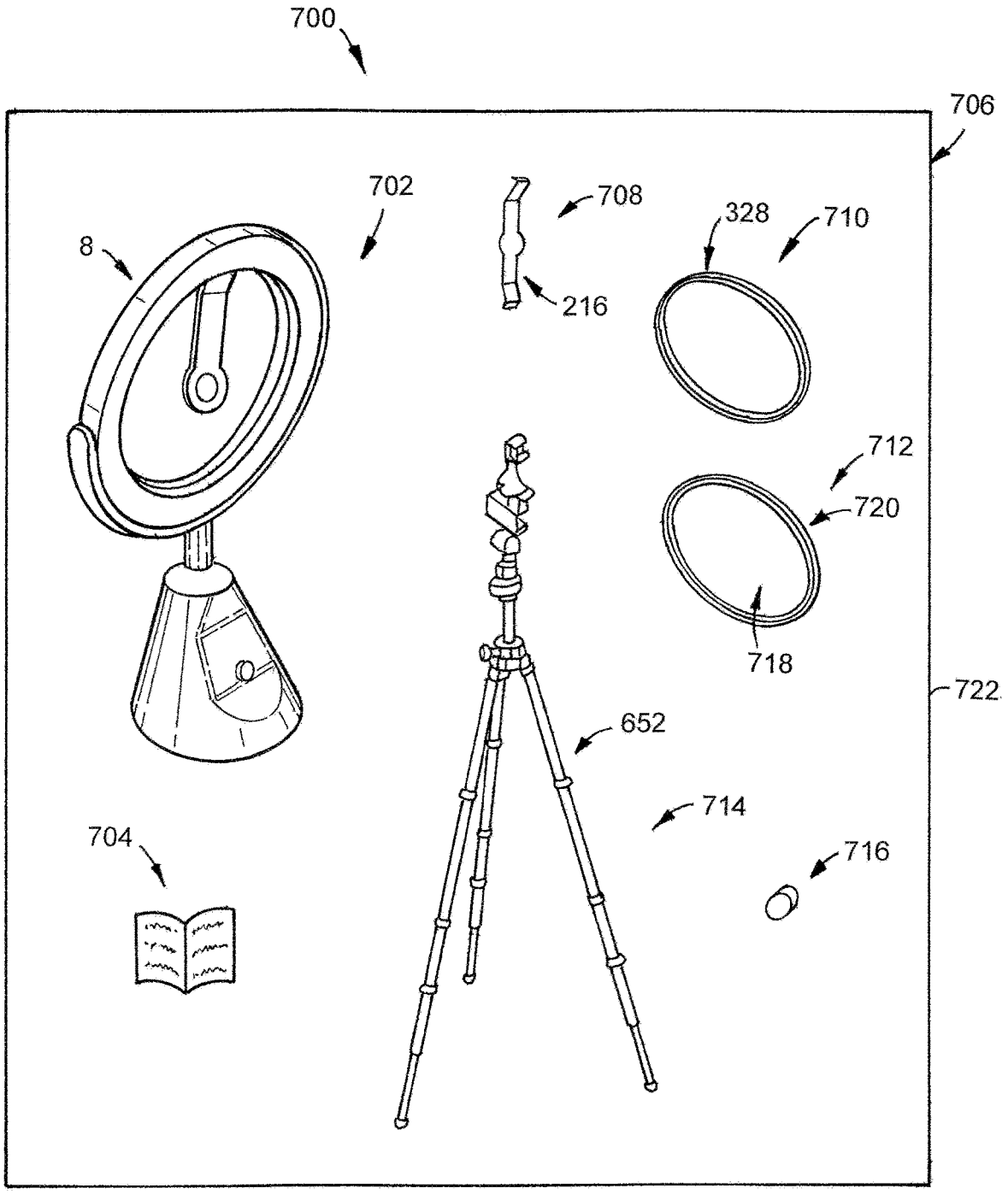
FIG. 16 illustrates an example kit that includes an illumination device.

FIG. 16 illustrates an example embodiment of a kit 700 that includes an illumination device 702 according to an embodiment; instructions for use 704; and a storage container 706.

Any suitable illumination device can be included in a kit and selection of a suitable illumination device to include in a kit can be based on various considerations, including the intended use of the illumination device. Examples of illumination devices considered suitable to include in a kit include illumination device 8, illumination device 208, illumination device 408, illumination device 908, illumination device 1108, variations of the illumination devices described herein, and any other illumination device according to an embodiment. In the illustrated embodiment, the kit 700 includes illumination device 8, as shown in FIGS. 1 and 2.

Optional additional components considered suitable to include in a kit are also illustrated in FIG. 16 and include a second support arm 708 according to an embodiment, a first mirror 710, a second mirror 712, a stand 714, and a steel disc 716 that can be attached, either fixedly or releasably, to an electronic device to accomplish releasable attachment between the electronic device and a support arm. Any suitable support arm, mirror, and stand can be included in a kit and selection of a suitable support arm, mirror, and stand to include in a kit can be based on various considerations, including the intended use of the illumination device. Examples of support arms considered suitable to include in a kit include support arm 16, support arm 216, support arm 416, support arm 916, support arm 1116, variations of the support arms described herein, and any other support arm according to an embodiment. Examples of mirrors and stands considered suitable to include in a kit include mirror 328, mirror 528, mirror 1028, mirror 1228, stand 652, variations of the mirrors and/or stands described herein, and any other mirror and/or stand considered suitable for a particular embodiment. In the illustrated embodiment, the kit 700 includes support arm 216, as shown in FIGS. 3, 4, 5, 6, 7, and 8, mirror 328, as shown in FIGS. 3, 4, 5, 6, 7, and 8, and stand 652, as shown in FIGS. 14, and 15. In the illustrated embodiment, the second mirror 712 is similar to the first mirror 710 except that it includes a first reflective surface 718 that has a first magnification and a second reflective surface 720 that is opposably facing the first reflective surface and that has a second magnification that is different than the first magnification.

While the kit 700 has been illustrated as including an illumination device 702, any suitable number, and type, of illumination devices can be included in a kit. Selection of a suitable number of illumination devices to include in a kit according to a particular embodiment can be based on various considerations, such as the intended use of the kit. Examples of suitable numbers of illumination devices to include in a kit include at least one, one, two, a plurality, three, four, and any other number considered suitable for a particular embodiment.

While the kit 700 has been illustrated as including optional components, such as a second support arm 708, a first mirror 710, a second mirror 712, a stand 714, and a steel disc 716, a kit can include any suitable number, and type, of optional components. Examples of numbers of optional components considered suitable to include in a kit, such as support arms, mirrors, steel discs, and/or stands include zero, one, at least one, two, a plurality, three, four, five, more than five, and any other number considered suitable for a particular embodiment. Examples of additional optional components considered suitable to include in a kit include filters, such as those described herein.

A storage container included in a kit can have any suitable structural arrangement and be formed of any suitable material and selection of a suitable structural arrangement and material to form a storage container can be based on various considerations, including the number of illumination devices included in a kit. Examples of structural arrangements considered suitable to form a storage container include boxes, boxes that include a lid, boxes that include a lid attached to the box (e.g., pivotably attached), bags, and any other structural arrangement considered suitable for a particular embodiment. Examples of materials considered suitable to form a storage container include metals, plastics, threaded materials, combinations of the materials described herein, and any other material considered suitable for a particular embodiment. In the illustrated embodiment, the storage container 706 is a box 722 formed of a rigid plastic.

Methods of using an illumination device are described herein. While the methods described herein are shown and described as series of acts, it is to be understood and appreciated that the methods are not limited by the order of acts described and illustrated, as some acts may in accordance with these methods, be omitted, be repeated, or occur in different orders and/or concurrently with other acts described herein.

Figure 17:
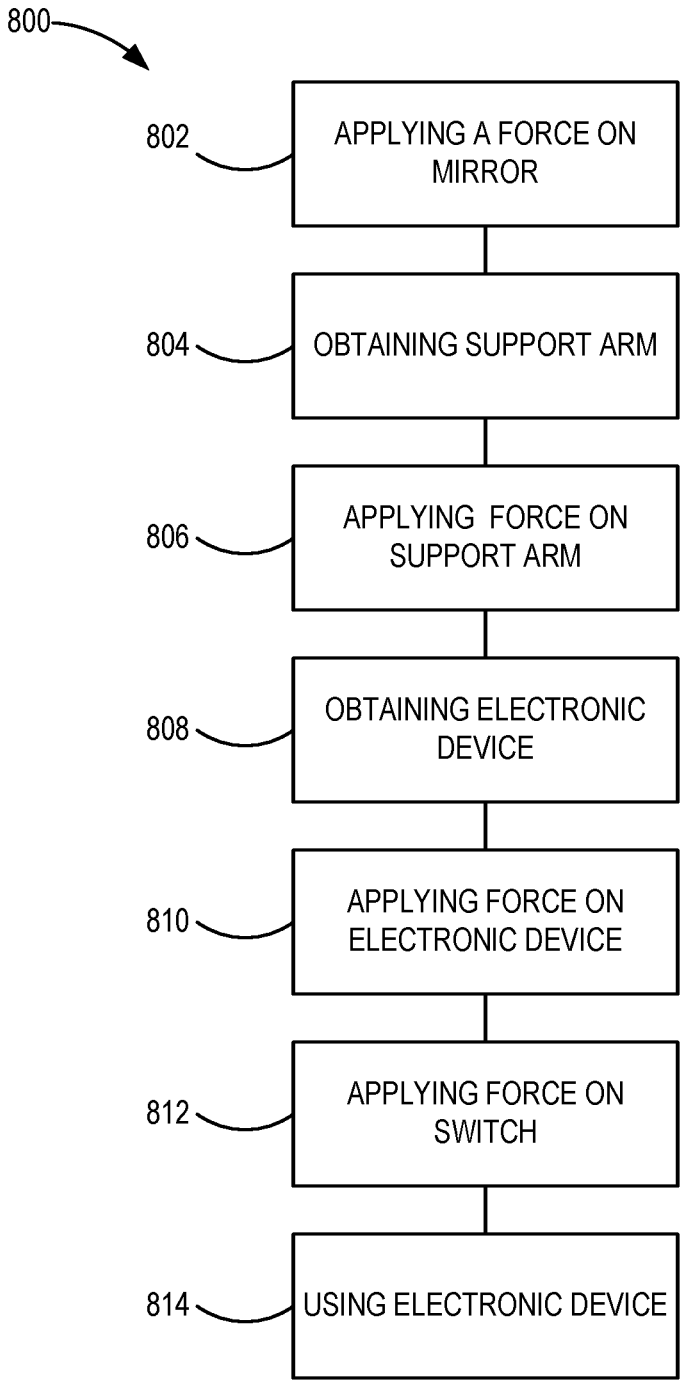
FIG. 17 is a schematic illustration of an example method of using an illumination device.

FIG. 17 is a schematic illustration of an example method 800 of using an illumination device. A step 802 comprises applying a force on a mirror disposed within a frame of an illumination device away from the frame until the mirror becomes free of the frame. Another step 804 comprises obtaining a support arm. Another step 806 comprises applying a force on the support arm toward the frame of the illumination device until the support arm is releasably attached to the frame. Another step 808 comprises obtaining an electronic device. Another step 810 comprises applying a force on the electronic device toward the support arm until the electronic device is releasably attached to the support arm. Another step 812 comprises applying a force on a switch of the illumination device until the light source moves from an off state to an on state. Another step 814 comprises using the electronic device.

Method 800 can be accomplished using any suitable illumination device according to an embodiment described herein. Examples of illumination devices considered suitable to complete method 800 include illumination device 8, illumination device 208, illumination device 408, illumination device 908, illumination device 1108, variations of the illumination devices described herein, and any other illumination device according to an embodiment. An example illumination device that can be used to accomplish the methods, steps, optional steps, and/or alternative steps described herein is illumination device 208 and is illustrated and described with respect to FIGS. 3, 4, 5, 6, 7 and 8. The illumination device 208 includes a base 210, a frame support 212, a frame 214, a support arm 216, a light source 218, a switch 220, a lens 326, a mirror 328, and a port 330.

Step 802 can be accomplished by applying a force on any suitable portion of a mirror disposed within a frame of an illumination device away from the frame until the mirror becomes free of the frame. For example, in embodiments in which illumination device 208 is being utilized, force can be applied through the lens first recess 364 and the lens second recess 366, and onto the mirror casing 396 until the mirror 328 becomes free of the frame 214. Alternatively, force can be applied on a back surface of a mirror (e.g., through a frame opening, using moveable button 1204) until the mirror becomes free of the frame. Optionally, step 802 can be omitted in embodiments in which a mirror is not attached to a frame.

While method 800 has been described as being completed using illumination device 208, which includes support arm 216, step 804 can be accomplished using any suitable support arm according to an embodiment described herein. Examples of support arms considered suitable to complete method 800 include support arm 16, support arm 216, support arm 416, variations of the support arms described herein, and any other support arm according to an embodiment. Alternatively, step 804 can be omitted in embodiments in which a support arm is already attached to a frame.

Step 806 can be accomplished by applying a force on any suitable portion of the support arm obtained in step 804 toward the frame of the illumination device until the support arm is releasably attached to the frame. For example, in embodiments in which illumination device 208 is being utilized, force can be applied on the support arm 216 until the support arm first end 290 is disposed within the first slot 380 and the support arm second end 292 is disposed within the second slot 382. In embodiments in which illumination device 8 is being utilized, force can be applied on the support arm 16 until the support arm first end 90 is disposed within the frame third recess 78. Alternatively, step 806 can be omitted in embodiments in which a support arm is already attached to a frame.

Step 808 can be accomplished using any suitable electronic device and selection of a suitable electronic device can be based on various considerations, including the intended use of the illumination device. Examples of types of electronic devices considered suitable to releasably attach to a support arm include smart phones, tablets, cellular phones, communications devices, such as devices that include wireless networking technology (e.g., Wi-Fi, Bluetooth) or other communications functionalities, devices that include one or more cameras for recording content, such as still photographs and/or video, combinations of the electronic devices described herein, and any other electronic device considered suitable for a particular embodiment.

Step 810 can be accomplished by applying a force on any suitable portion of the electronic device obtained in step 808 toward the support arm until the electronic device is releasably attached to the support arm. For example, in embodiments in which illumination device 208 is being utilized, force can be applied on the electronic device until the back surface of the electronic device, or a component attached to the electronic device, is releasably attached to the support arm magnet 298. In embodiments in which illumination device 8 is being utilized, force can be applied on the electronic device until the back surface of the electronic device, or a component attached to the electronic device, is releasably attached to the support arm magnet 98. In embodiments in which illumination device 908 is being utilized, force can be applied on the electronic device until the back surface of the electronic device, or a component attached to the electronic device, is releasably attached to the support arm magnet 998. In embodiments in which illumination device 1108 is being utilized, force can be applied on the electronic device until the back surface of the electronic device, or a component attached to the electronic device, is releasably attached to the support arm magnet 1198 or a mirror that is releasably attached to the support arm magnet 1198.

An electronic device can be positioned on a support arm in any suitable orientation, such as in portrait, landscape, or a position between portrait and landscape. An optional step that can be included in method 800 comprises obtaining a disc formed of a magnetic material. Another optional step comprises attaching the disc to the electronic device using any suitable technique or method of attachment (e.g., adhesive) and using the disc to releasably attach the electronic device to a support arm, as described herein. Each of these optional steps can be accomplished subsequent to step 808 and/or prior to step 810 such that step 810 can be accomplished by applying a force on the electronic device until the disc is releasably attached to the attachment portion of a support arm.

Step 812 can be accomplished by applying a force on any suitable portion of a switch of an illumination device until the light source moves from an off state to an on state. For example, in embodiments in which illumination device 208 is being utilized, a force can be applied on the switch 220 until the light source 218 moves to the on state. In embodiments in which illumination device 8 is being utilized, a force can be applied on the switch 20 until the light source 218 moves to the on state. In embodiments in which illumination device 1108 is being utilized, a force can be applied on the base 1110 until the light source 1118 moves to the on state. Alternatively, in embodiments in which a light source is already in an on state, step 812 can be omitted from method 800. An optional step that can be included in method 800 comprises applying a force on the switch until the light source moves from the on state to the off state. This optional step can be accomplished by applying a force on any suitable portion of a switch of an illumination device until the light source moves from an on state to an off state. In embodiments in which a switch is a touch switch or manipulates the power provided to a light source, an optional step comprises repeating step 812.

Step 814 can be accomplished using any suitable technique or method of using an electronic device and selection of a suitable technique or method can be based on various considerations, including the type of electronic device being used with an illumination device. For example, step 814 can be accomplished by applying a force on a button (e.g., physical, electronic) of an electronic device that activates a camera to take a still photograph or start recording a video. An optional step that can be completed subsequent to step 814 comprises stopping the use of the electronic device. This optional step can be accomplished by applying a force on a button (e.g., physical, electronic) of an electronic device that deactivates a camera that is taking a still photograph or recording a video.

An optional step that can be included in method 800 comprises obtaining an illumination device. Another optional step that can be included in method 800 comprises connecting the illumination device to a power source. Another optional step that can be included in method 800 comprises applying a force on the support arm away from the frame until the support arm becomes free of the frame. This optional step can be completed prior to step 802 in embodiments in which a support arm is attached to a frame and it is desired to remove it and attach a mirror to the frame. Alternatively, this optional step can be completed subsequent to step 814 such that both the electronic device and the support arm are removed from the frame. Alternatively, this optional step can be completed subsequent to a step that comprises applying a force on the electronic device until the electronic device becomes free of the support arm. Another optional step that can be included in method 800 comprises applying a force on the mirror toward the frame until the mirror is releasably attached to the frame. This optional step can be completed subsequent to the step of applying a force on the support arm until it is free of the frame or in embodiments in which a support arm is not attached to the frame. Another optional step comprises attaching an electronic device to a port (e.g., USB port) included on an illumination device. This optional step can be accomplished by applying a force on a first end of a connector that is directed toward the electronic device until the connector is attached to the electronic device and applying a force on a second end of a connector that is directed toward the port until the connector is attached to the port.

In embodiments in which illumination device 408 is being utilized, the below optional steps can be included in method 800. A first optional step comprises applying a force on a frame of an illumination device until it is disposed adjacent to a base stand on which a mirror is pre-attached, or that does not have a mirror attached. Another optional step comprises releasably attaching the frame to the base stand. This optional step can be accomplished using any suitable technique or method of attachment, such as one or more fasteners as shown in FIGS. 9, 10, and 11. Another optional step comprises applying a force on a frame of an illumination device until it is free of a base stand(s) and disposed adjacent to a stand on which a camera is pre-attached, or that does not have a camera attached to the stand. Another optional step comprises releasably attaching the frame to the stand. This optional step can be accomplished using any suitable technique or method of attachment, such as one or more fasteners as shown in FIGS. 14 and 15.

Figure 18:
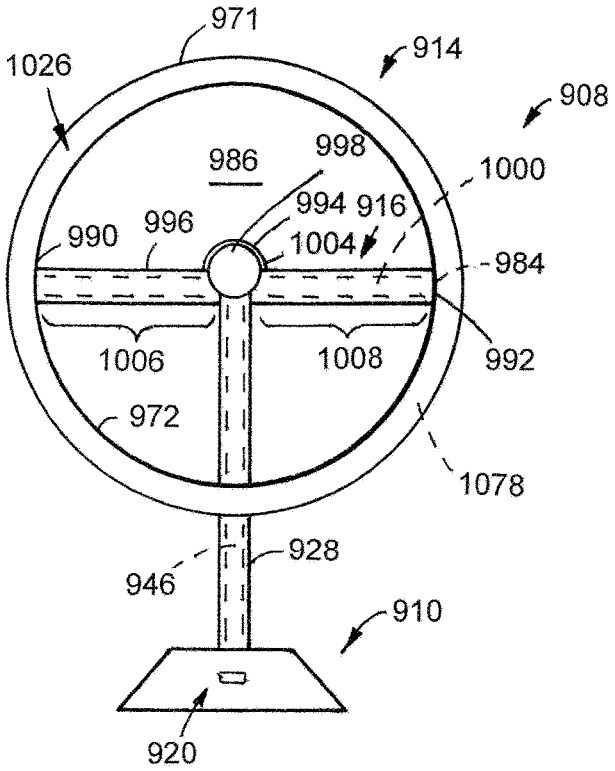
FIG. 18 is an elevation view of a fourth example illumination device in a first configuration.
Figure 19:
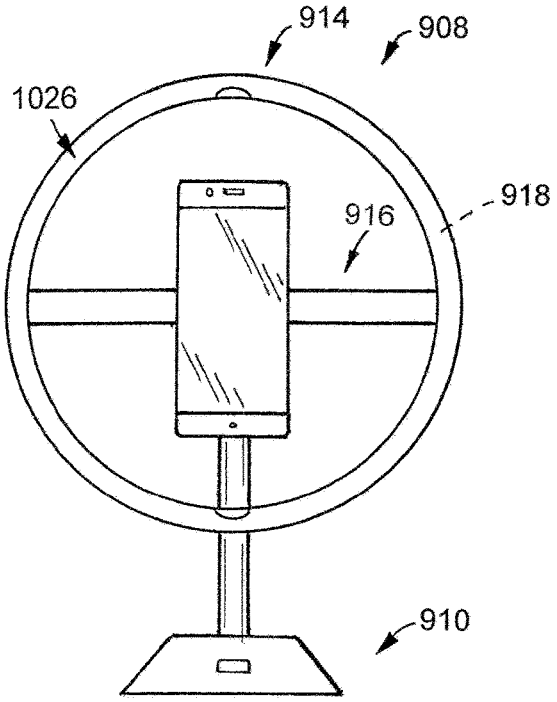
FIG. 19 is an elevation view of the illumination device illustrated in FIG. 18 in a second configuration.
Figure 20:
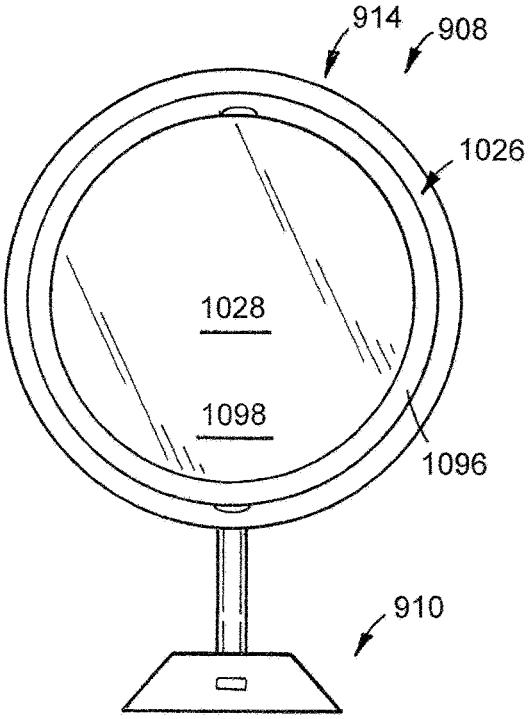
FIG. 20 is an elevation view of the illumination device illustrated in FIG. 18 in a third configuration.

FIGS. 18, 19, and 20 illustrate another example illumination device 908. The illumination device 908 is similar to the illumination device 208 illustrated in FIGS. 3, 4, 5, 6, 7, and 8 and described above, except as detailed below. In the illustrated embodiment, the illumination device 908 includes a base 910, a frame 914, a support arm 916, a light source 918, a switch 920, a lens 1026, and a mirror 1028.

In the illustrated embodiment, the frame 914 has a first configuration, a second configuration, and a third configuration. In the first configuration, as illustrated in FIG. 18, the support arm 916 is attached to the frame 914 independent of the mirror 1028. In the second configuration, as illustrated in FIG. 19, the support arm 916 is attached to the frame 914 an electronic device is releasably attached to the support arm 916. In the third configuration, as illustrated in FIG. 20, the support arm 916 is attached to the frame 914 and the mirror 1028 is releasably attached to the frame 914.

In the illustrated embodiment, the frame 914 is rotatably attached directly to the elongate shaft 928 of the base 910 using the support arm 916. The frame 914 omits the inclusion of a frame first magnet, a frame second magnet, a frame first recess, a frame second recess, a frame first notch, a frame second notch, a frame first projection, a frame second projection, a frame fourth recess, and a frame fifth recess. The frame first passageway 984 extends through the frame main body 968 and provides access to the passageway 1000 defined by the support arm 916, as described in more detail herein. The frame opening 986 extends from the frame front surface 970 to the frame back surface 972 and is sized and configured to receive a portion of a support arm 916 and/or a mirror 1028, as described in more detail herein.

In the illustrated embodiment, the lens 1026 is attached to the frame 914 and over the light source 918. The lens 1026 omits the inclusion of a lens third recess and a lens fourth recess.

In the illustrated embodiment, the support arm 916 is fixedly attached to the frame 914 and the elongate shaft 928 of the base 910. However, other types of attachments, such as those described herein (e.g., releasable attachments) can be used between a base and a support arm and/or a support arm and a frame. The support arm 916 has a support arm first end 990, a support arm second end 992, a support arm attachment portion 994, a support arm main body 996, and a support arm magnet 998. The support arm main body 996 does not define any bends and defines a passageway 1000, a support arm recess 1004, a support arm first portion 1006, and a support arm second portion 1008. The passageway 1000 extends from the support arm first end 990 to the support arm second end 992. However, alternative embodiments can include a support arm that only defines a passageway along a portion of the length of the support arm. Each of the support arm first end 990 and the support arm second end 992 is fixedly attached to the frame 914 such that the passageway 1000 defined by the support arm 1000 is in communication with the chamber 1078 cooperatively defined by the frame 914 and the lens 1026 and the passageway 946 defined by the elongate shaft 928. Each of the passageway 1000, the chamber 1078, and the passageway 946 is sized and configured to house various components that operatively connect the light source 918 to the switch 920, as described in more detail herein.

The support arm first portion 1006 extends from the support arm first end 990 to the support arm attachment portion 994. The support arm second portion 1008 extends from the support arm second end 992 to the support arm attachment portion 994. The support arm attachment portion 994, which in the illustrated embodiment includes the support arm recess 1004 and the support arm magnet 998, is disposed between the support arm first end 990 and the support arm second end 992. The support arm magnet 998 is sized and configured to accomplish releasable attachment between the support arm 916 and an electronic device such that the position of the electronic device is maintained during use, as illustrated in FIG. 19, and between the support arm 916 and the mirror 1028 such that the position of the mirror 1028 is maintained during use, as illustrated in FIG. 20. In the illustrated embodiment, the support arm 916 is sized and configured to position the support arm attachment portion 994 at a location between a first plane that contains the frame first front surface 970 and a second plane that contains the frame back surface 972.

As illustrated in FIG. 20, the mirror 1028 is releasably attached to the frame 914 when the frame 914 is in the third configuration and has a mirror casing 1096 and a reflective surface 1098. The mirror casing 1096 surrounds the perimeter and back surface of the reflective surface 1098 and is formed of a magnetic material such that releasable attachment to the frame 914 can be accomplished using the support arm magnet 998. When attached to the frame 914, the mirror 1028 is positioned such that the entire mirror 1028 is disposed between a first plane that contains the frame front surface 970 and a second plane that contains the frame back surface 972.

FIGS. 21, 22, 23, 24, 25, and 26 illustrate another example illumination device 1108. The illumination device 1108 is similar to the illumination device 208 illustrated in FIGS. 3, 4, 5, 6, 7, and 8 and described above, except as detailed below. In the illustrated embodiment, the illumination device 1108 includes a base 1110, a frame 1114, a support arm 1116, a light source 1118, a switch 1120, a lens 1226, a mirror 1228, and a port 1230.

In the illustrated embodiment, the base 1110 includes an adjustment collar 1234, a collet 1235, and the stand 1126 and the elongate shaft 1128 are separate members that are releasably attachable to one another using a snap fit attachment. The elongate shaft 1128 has a first portion 1129 and a second portion 1131 releasably attached to the first portion 1129 using the adjustment collar 1234 and the collet 1235. The elongate shaft main body 1144 of the first portion 1129 defines an exterior thread 1237. The elongate member body 1144 of the elongate shaft 1128 also defines a passageway 1146 that extends through both the first portion 1129 and the second portion 1131 that is sized and configured to receive various components to operatively attach the light source 1118 to the switch 1120. The passageway 1146 of the first portion 1129 is sized and configured to receive a portion of the second portion 1131. The collet 1235 defines a passageway 1236 that is sized and configured to receive a portion of the second portion 1131. The adjustment collar 1234 has an adjustment collar main body 1238 that defines an adjustment collar passageway 1240 and an adjustment collar interior thread 1241. The adjustment collar passageway 1240 is sized and configured to receive a portion of the second portion 1131 of the elongate shaft 1128 and the adjustment collar interior thread 1241 is sized and configured to mate with the exterior thread 1237. The adjustment collar 1234 is moveable between a first configuration, in which the second portion 1131 of the elongate shaft 1128 is moveable relative to the first portion 1129 of the elongate shaft 1128, and a second configuration, in which the second portion 1131 of the elongate shaft 1128 is fixed relative to the first portion 1129 of the elongate shaft 1128. This structural arrangement provides a mechanism for including a telescoping elongate shaft 1128 on the illumination device 208.

A collet can be formed of any suitable material and manufactured using any suitable technique or method of manufacture. Selection of a suitable material and technique or method of manufacture can be based on various considerations, including the structural arrangement of the illumination device of which the collet is a component. Examples of materials considered suitable to form a collet include wood, polymers, plastics, rubber, metals, aluminum, materials that reduce interference with wireless technology (e.g., Wi-Fi, Bluetooth), combinations of the materials described herein, and any other material considered suitable for a particular embodiment. Examples of techniques and methods of manufacture considered suitable to form a collet include injection molding, casting, and any other technique or method considered suitable for a particular embodiment.

Figure 21:
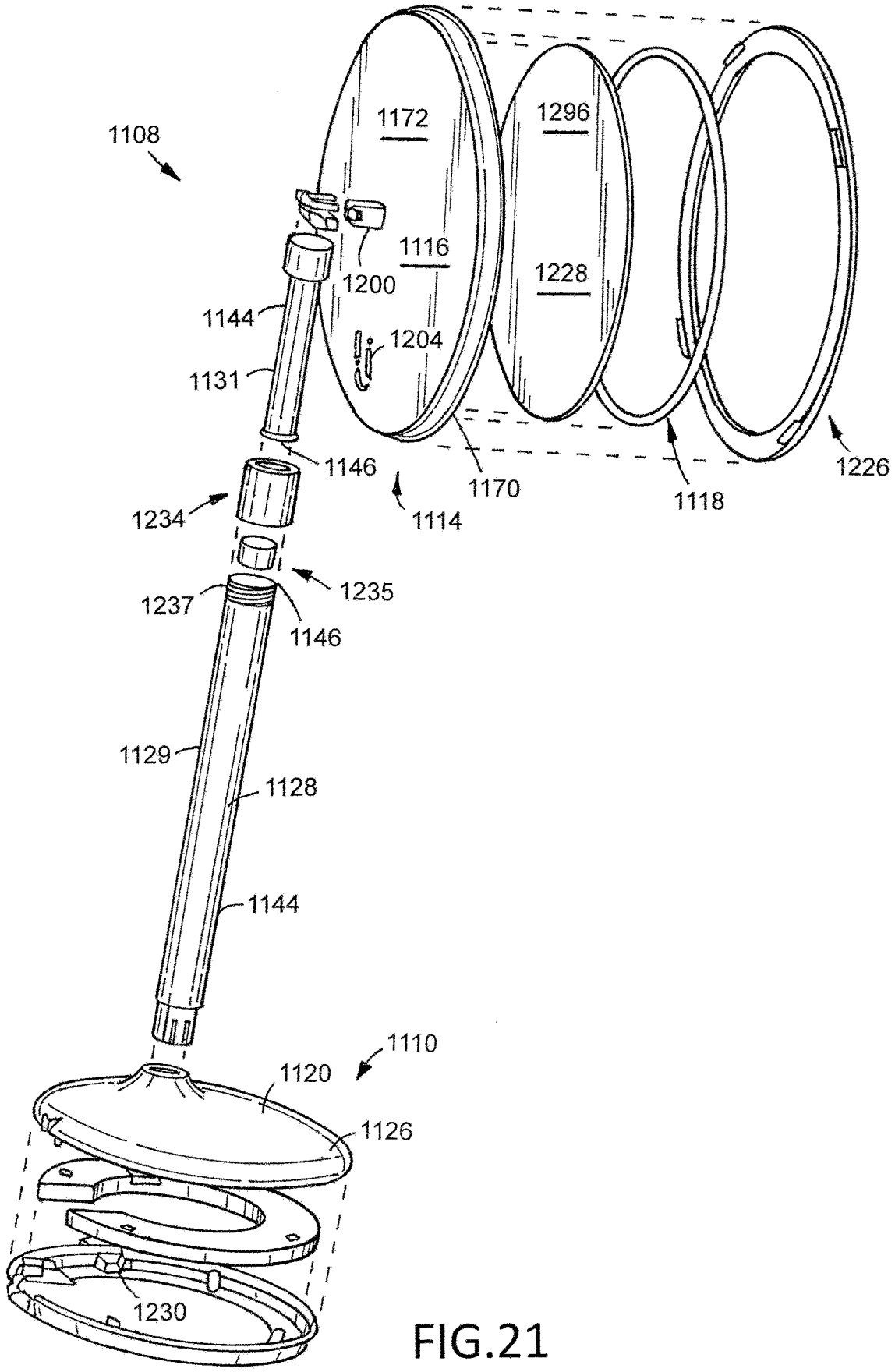
FIG. 21 is an exploded perspective view of a fifth example illumination device.

In the illustrated embodiment, the frame 1114 is moveably (e.g., pivotably) attached directly to the elongate shaft 1128 of the base 1110 using the support arm 1116, and is movable between a first configuration, a second configuration, and a third configuration. In the first configuration, the support arm 1116 is attached to the frame 1114 independent of the mirror 1228. In the second configuration, the support arm 1116 is attached to the frame 1114 and an electronic device is releasably attached to the support arm 1116. In the third configuration, as illustrated in FIG. 21, the support arm 1116 is attached to the frame 1114 and the mirror 1228 is releasably attached to the frame 1114. In the illustrated embodiment, the frame 1114 omits the inclusion of a frame first magnet, a frame second magnet, a frame first recess, a frame second recess, a frame first notch, a frame second notch, a frame opening, a frame first projection, a frame second projection, a frame fourth recess, and a frame fifth recess. The frame first passageway 1184 extends through the frame main body 1168 and provides access to an environment outside of the chamber 1278 cooperatively defined by the frame 1114 and the lens 1226.

In the illustrated embodiment, the switch 1120 is a touch switch that moves the light source 1118 between the on state and the off state when a user touches the base 1110 and the lens 1226 is attached to the frame 1114 and over the light source 1118. The lens 1226 omits the inclusion of a lens third recess and a lens fourth recess and is releasably attached to the frame 1114 using a snap fit attachment.

Figure 22:
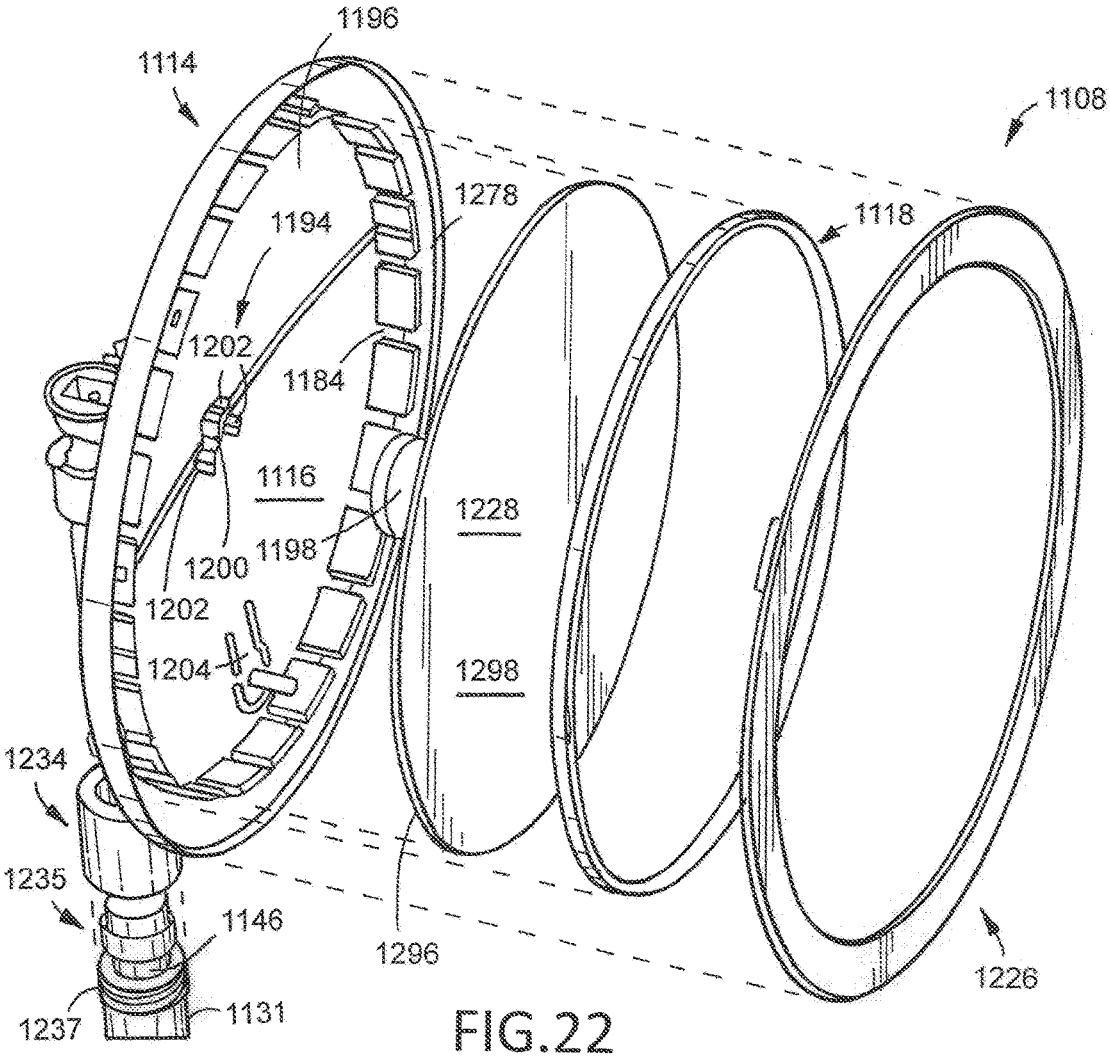
FIG. 22 is a partial exploded perspective view of the illumination device illustrated in FIG. 21.
Figure 23:
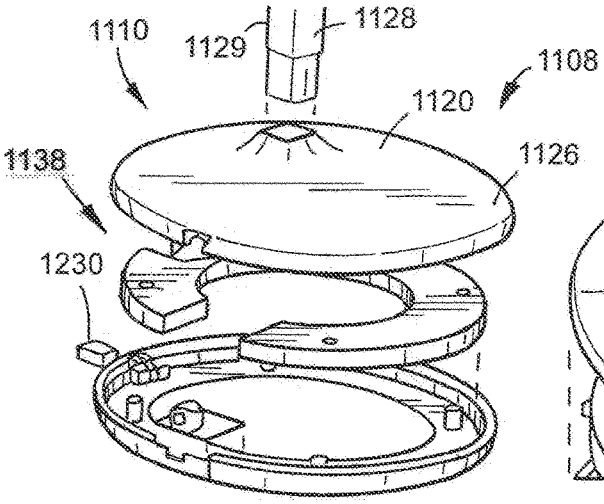
FIG. 23 is another partial exploded perspective view of the illumination device illustrated in FIG. 21.
Figure 24:
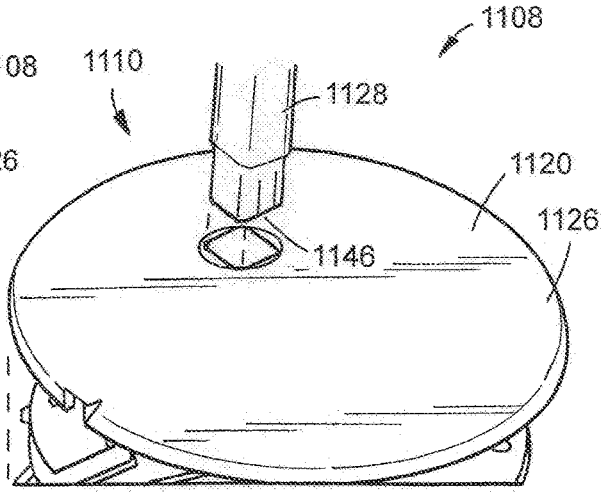
FIG. 24 is another partial exploded perspective view of the illumination device illustrated in FIG. 21.
Figure 25:
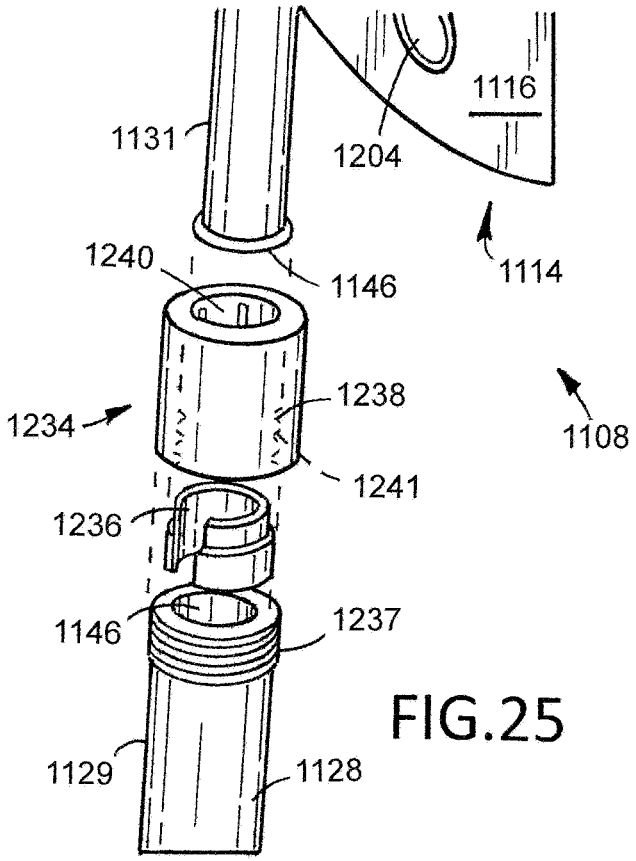
FIG. 25 is another partial exploded perspective view of the illumination device illustrated in FIG. 21.
Figure 26:
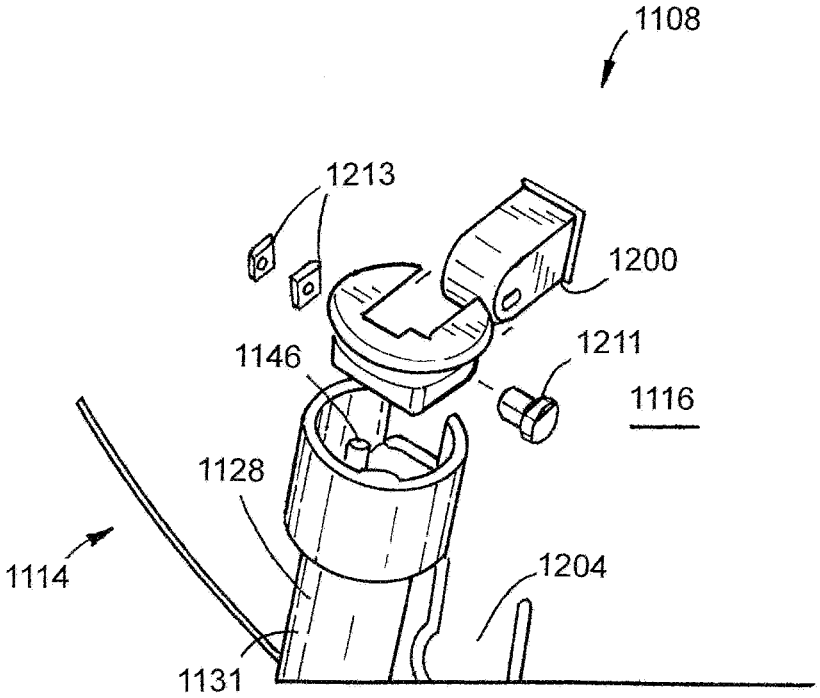
FIG. 26 is another partial exploded perspective view of the illumination device illustrated in FIG. 21.

In the illustrated embodiment, the support arm 1116 is an integrated component of the frame 1114 such that it is fixedly attached to the frame 1114 and is releasably attached to the elongate shaft 1128 of the base 1110 using a threaded member 1211 and nuts 1213. However, other types of attachments, such as those described herein can be used between a base and a support arm (e.g., releasable attachments). As shown in FIG. 22, the support arm 1116 has a support arm attachment portion 1194, a support arm main body 1196, and a support arm magnet 1198. The support arm main body 1196 does not define any bends and defines a passageway 1200, a plurality of projections 1202, and a moveable button 1204. The passageway 1200 extends through the support arm main body 1196 and provides access to the passageway 1146 defined by the elongate shaft 1128. Each of the passageway 1200, the chamber 1278, and the passageway 1146 is sized and configured to house various components that operatively connect the light source 1118 to the switch 1120, as described in more detail herein. For example, various components can be operatively connected to the light source 1118, pass through the frame first passageway 1184, through the support arm passageway 1200, through the passageway 1146 defined by the elongate shaft 1128, and into the stand chamber 1138 such that the components can be operatively attached to the switch or other components included in the illumination device 1108. The moveable button 1204 is pivotably attached to the support arm 1116 and can be used to remove a mirror 1228 when releasably attached to the frame 1114.

Each projection of the plurality of projections 1202 extends from the support arm main body 1196 and cooperatively the plurality of projections 1202 is sized and configured to receive the support arm magnet 1198 such that the support arm magnet 1198 is releasably attached to the support arm 1116. However, alternative embodiments can omit the inclusion of a plurality of projections and a support arm magnet can be directly attached to the support arm using any suitable technique or method of attachment (e.g., adhesive). The support arm magnet 1198 is sized and configured to accomplish releasable attachment between the support arm 1116 and an electronic device such that the position of the electronic device is maintained during use and between the support arm 1116 and the mirror 1228 such that the position of the mirror 1228 is maintained during use.

In the illustrated embodiment, the mirror 1228 is releasably attached to the frame 1114 when the frame 1114 is in the third configuration using the support arm magnet 1198. The mirror 1228 has a mirror casing 1296 and a reflective surface 1298. The mirror casing 1296 surrounds the perimeter and back surface of the reflective surface 1298 and is formed of a magnetic material such that releasable attachment to the frame 1114 can be accomplished using the support arm magnet 1198. When attached to the frame 1114, the mirror 1228 is positioned such that a portion of the mirror 1228 is disposed between a first plane that contains the frame first front surface 1170 and a second plane that contains the frame back surface 1172.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. An illumination device comprising:

a base having a first end and a second end;

a frame attached to the base and having a frame main body defining a frame front surface, a frame back surface, and a frame opening extending from the frame front surface to the frame back surface, each of the frame front surface and the frame back surface extending around the frame opening;

a support arm releasably attached to the frame and partially disposed within the frame opening;

a light source attached to the frame and having an on state and an off state; and a switch operatively connected to the light source and adapted to move the light source between the on state and the off state;

wherein the frame has a first configuration, a second configuration, and a third configuration;

further comprising a mirror;

wherein the support arm and the mirror are free of attachment to the frame in the first configuration;

wherein the support arm is releasably attached to the frame and partially disposed within the fane opening independent of the mirror when the frame is in the second configuration; and wherein the mirror is releasably attached to the frame and disposed within the frame opening independent of the support arm when the frame is in the third configuration.

2. The illumination device of claim 1, wherein the fame has a frame first magnet and a frame second magnet, each of the frame first magnet and the frame second magnet attached to the frame main body.

3. The illumination device of claim 2, wherein the mirror includes a mirror casing that is formed of a magnetic material that is adapted to releasably attach the mirror casing to each of the frame first magnet aid the frame second magnet; and wherein the support arm is formed of a magnetic material that is adapted to releasably attach the support arm to each of the frame first magnet and the frame second magnet.

4. The illumination device of claim 1, further comprising a frame support attached to the base and having a frame support main body defining a frame support opening; and wherein the frame is attached to the frame support and partially disposed within the frame support opening.

5. The illumination device of claim 4, wherein the frame support is movably attached to the base.

6. The illumination device of claim 4, wherein the frame is rotatably attached to the frame support.

7. The illumination device of claim 1, wherein the support am is disposed between a first plane that contains the frame front surface and a second plane that contains the frame back surface.

8. The illumination device of claim 1, wherein the support arm has a support arm attachment portion and defines a support arm first end, a support arm second end, a support arm first bend, a support arm second bend, a support arm first portion, a support arm second portion, and a support arm third portion, the support arm first portion extending from the support arm first end to the support arm first bend, the support arm second portion extending from the support arm first bend to the support arm second bend, the support arm third portion extending from the support arm second bend to the support arm attachment portion, the support arm first portion disposed at a first angle relative to the support arm second portion, the support arm second portion disposed at a second angle relative to the support arm third portion that is different than the first angle.

9. The illumination device of claim 8, wherein the first angle is an acute angle; and wherein the second angle is an obtuse angle.

10. The illumination device of claim 1, wherein the frame main body defines a frame recess; and wherein the light source is disposed within the frame recess.

11. The illumination device of claim 10, further comprising a lens attached to the frame and disposed over the light source.

12. The illumination device of claim 1, wherein the frame is releasably attached to the base.

13. An illumination device comprising:

a base having a first end and a second end;

a frame support attached to the base and having a frame support main body defining a frame support opening;

a frame rotatably attached to the frame support and partially disposed within the frame support opening, the frame having a first configuration, a second configuration, and a frame main body defining a frame front surface, a fame back surface, a frame opening, and a frame recess, the frame opening extending from the frame front surface to the frame back surface, each of the frame front surface and the frame back surface extending around the frame opening;

a support arm releasably attached to the frame when the frame is in the second configuration and partially disposed within the fame opening;

a light source attached to the frame and disposed within the frame recess, the light source having an on state and an off state;

a lens attached to the frame and disposed over the light source;

a mirror releasably attached to the frame and disposed within the frame opening when the frame is in the first configuration independent of the support arm; and a switch operatively connected to the light source and adapted to move the light source between the on state and the off state.

14. The illumination device of claim 13, wherein the support arm is disposed between a first plane that contains the frame front surface and a second plane that contains the frame back surface.

15. The illumination device of claim 13, wherein the support arm has a support arm attachment portion and defines a support arm first end, a support arm second end, a support arm first bend, a support arm second bend, a support arm first portion, a support arm second portion, and a support arm third portion, the support arm first portion extending from the support arm first end to the support arm first bend, the support arm second portion extending from the support arm first bend to the support arm second bend, the support arm third portion extending from the support arm second bend to the support arm attachment portion, the support arm first portion disposed at a first angle relative to the support arm second portion, the support arm second portion disposed at a second angle relative to the support arm third portion that is different than the first angle.

16. The illumination device of claim 15, wherein the first angle is an acute angle; and wherein the second angle is an obtuse angle.

17. The illumination device of claim 13, wherein the frame has a frame first magnet and a frame second magnet, each of the frame first magnet and the frame second magnet attached to the frame main body.

18. The illumination device of claim 17, wherein the mirror includes a mirror casing that is formed of a magnetic material that is adapted to releasably attach the mirror casing to each of the frame first magnet and the frame second magnet; and wherein the support arm is formed of a magnetic material that is adapted to releasably attach the support arm to each of the frame first magnet and the frame second magnet.

19. An illumination device comprising:

a base having a first end and a second end;

a frame moveably attached to the base, the frame having a first configuration a second configuration, and a third configuration and a fame main body defining a frame front surface, a frame back surface, a frame opening, and a frame recess, the frame opening extending from the frame front surface to the frame back surface, each of the frame front surface and the frame back surface extending around the frame opening;

a support arm attached to the frame when the frame is in each of the first configuration, the second configuration, and the third configuration, the support arm having a support arm attachment portion, the support arm partially disposed within the fame opening in the second configuration;

a light source attached to the frame and disposed within the frame recess, the light source having an on state and an off state;

a lens attached to the frame and disposed over the light source;

a mirror releasably attached to the support arm attachment portion when the frame is in the third configuration, the mirror having a mirror casing formed of a magnetic material that is adapted to releasably attach the mirror casing to the support arm, the mirror free of attachment to the support arm in the first configuration and second configuration; and a switch operatively connected to the light source and adapted to move the light source between the on state and the off state.

* * * * *